US011813879B2

(12) United States Patent
Ukai et al.

(10) Patent No.: US 11,813,879 B2
(45) Date of Patent: Nov. 14, 2023

(54) PRINTER

(71) Applicant: BROTHER KOGYO KABUSHIKI KAISHA, Nagoya (JP)

(72) Inventors: Shinji Ukai, Kiyosu (JP); Kentaro Murayama, Kasugai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 29 days.

(21) Appl. No.: 17/705,276

(22) Filed: Mar. 26, 2022

(65) Prior Publication Data

US 2022/0212488 A1 Jul. 7, 2022

Related U.S. Application Data

(63) Continuation of application No. PCT/JP2020/034879, filed on Sep. 15, 2020.

(30) Foreign Application Priority Data

Sep. 30, 2019 (JP) ..... 2019-178918

(51) Int. Cl.
*B41J 29/02* (2006.01)
*B41J 3/36* (2006.01)
(Continued)

(52) U.S. Cl.
CPC ..... *B41J 29/02* (2013.01); *B41J 3/36* (2013.01); *B41J 3/4075* (2013.01); *B41J 15/044* (2013.01); *B41J 32/00* (2013.01)

(58) Field of Classification Search
CPC ... B41J 29/02; B41J 3/36; B41J 3/4075; B41J 15/044; B41J 32/00
See application file for complete search history.

(56) References Cited

U.S. PATENT DOCUMENTS

2015/0343821 A1 12/2015 Sakano et al.
2016/0368290 A1 12/2016 Sakano
(Continued)

FOREIGN PATENT DOCUMENTS

JP 2011-201020 A 10/2011
JP 2015-182317 A 10/2015
(Continued)

OTHER PUBLICATIONS

Sakano, Hideki, Tape Cassette and Tape Printing Apparatus, Nov. 9, 2016, China, All Pages (Year: 2016).*
(Continued)

*Primary Examiner* — Justin Seo
*Assistant Examiner* — Tracey M McMillion
(74) *Attorney, Agent, or Firm* — KENEALY VAIDYA LLP

(57) ABSTRACT

A printer includes a housing having a first surface having a cassette mounting opening, a print head extending toward the cassette mounting opening from an inside of the housing, a platen roller, and a printing cassette mountable on the housing by insertion to the cassette mounting opening in a first direction. The first surface has first and second areas both adjacent to the cassette mounting opening. The second area is opposite to the first area with respect to the cassette mounting opening in a second direction orthogonal to the first direction. The first and second areas are located upstream from the print head in a cassette mounting direction. In a state where the printing cassette is mounted on the housing, respective portions of the printing cassette adjacent to the first and second areas are located outside the housing beyond the first and second areas, respectively, in the first direction.

11 Claims, 17 Drawing Sheets

(51) Int. Cl.

| | |
|---|---|
| ***B41J 15/04*** | (2006.01) |
| ***B41J 3/407*** | (2006.01) |
| ***B41J 32/00*** | (2006.01) |

(56) References Cited

U.S. PATENT DOCUMENTS

| | | | |
|---|---|---|---|
| 2017/0106677 | A1 | 4/2017 | Sakano et al. |
| 2017/0190195 | A1 | 7/2017 | Kosuge et al. |

FOREIGN PATENT DOCUMENTS

| | | | |
|---|---|---|---|
| JP | 2015-182319 | A | 10/2015 |
| JP | 2019-6018 | A | 1/2019 |
| WO | 2016/051948 | A1 | 4/2016 |

OTHER PUBLICATIONS

International Preliminary Report on Patentability and English language Written Opinion of the International Search Report for PCT/JP2020/034879 dated Apr. 5, 2022.
International Search Report for PCT/JP2020/034879 dated Nov. 24, 2020.
Office Action issued in Japanese Patent Application No. 2019-178918 dated Jul. 4, 2023.

* cited by examiner

110
DOWN
RIGHT
UP
LEFT
10
35A
112
32
31

110
112
10
35C
114
31
32
33
113
FRONT
DOWN
UP
REAR 110
114
110A
FRONT
RIGHT
LEFT
REAR
S
10
102
112
113
115

UP
RIGHT
LEFT
DOWN
110
10
31
32
113
35B 110
112
10
35D
115
31
32
33
113
FRONT
UP
DOWN
REAR

PRINTER

CROSS-REFERENCE TO RELATED APPLICATION

This is a continuation application of International Application No. PCT/JP2020/034879 filed on Sep. 15, 2020 which claims priority from Japanese Patent Application No. 2019-178918 filed on Sep. 30, 2019. The entire contents of the earlier applications are incorporated herein by reference.

TECHNICAL FIELD

Aspects of the disclosure relate to a printer.

BACKGROUND

In a device that performs printing on a tape, replacement and resupply of a tape is performed by attachment and detachment of a cassette accommodating a tape to and from a housing of the device. In such a device, for example, the cassette is placed in a recessed portion provided in the housing.

SUMMARY

In the above-described device, the cassette is mounted on the housing without protruding from the recessed portion. The cassette is provided with a tab for enabling the cassette to be removed from the recessed portion, which may increase a parts count of the cassette and lead to an increase in cost.

Accordingly, aspects of the disclosure provide a printer that may avoid an increase in cost of a cassette attachable to and detachable from a housing of the printer.

In one or more aspects of the disclosure, a printer may include a housing having a first surface having a cassette mounting opening, a print head disposed in the housing and extending toward the cassette mounting opening from an inside of the housing, a platen roller disposed in the housing and facing the print head, and a printing cassette mountable on the housing by insertion to the cassette mounting opening in a first direction.

The first surface may have a first area adjacent to the cassette mounting opening, and a second area adjacent to the cassette mounting opening. The second area may be opposite to the first area with respect to the cassette mounting opening in a second direction orthogonal to the first direction. The first area and the second area may be located upstream from the print head in a direction in which the printing cassette is mounted to the housing.

In a state where the printing cassette is mounted on the housing, a portion of the printing cassette adjacent to the first area may be located outside the housing beyond the first area in the first direction and a portion of the printing cassette adjacent to the second area may be located outside the housing beyond the second area in the first direction.

In one or more aspects of the disclosure, a printer may include a housing having a first surface having a cassette mounting opening, a print head disposed in the housing and extending toward the cassette mounting opening from an inside of the housing, a platen roller disposed in the housing and facing the print head, and a printing cassette mountable on the housing by insertion to the cassette mounting opening in a first direction.

The first surface may have a first area adjacent to the cassette mounting opening, and a second area adjacent to the cassette mounting opening. The second area may be opposite to the first area with respect to the cassette mounting opening in a second direction orthogonal to the first direction. The first area and the second area may be located upstream from the print head in a direction in which the printing cassette is mounted to the housing. In a state where the printing cassette is mounted on the housing, the printing cassette may protrude outside the housing beyond the first area and the second area in the up-down direction.

According to such a configuration, in a state where the printing cassette is mounted on the housing, a particular portion of the printing cassette may be located outside the housing beyond the first surface. Thus, the printing cassette may be held and removed from the housing without a tab. As a result, an increase in cost of the printing cassette may be avoided.

Further, the first area and the second area may be located upstream from the print head in the direction in which the printing cassette is mounted to the housing. Thus, the printing cassette may be held upstream from the print head. As a result, when the printing cassette is removed, interference between the printing cassette and the print head may be reduced.

In one or more aspects of the disclosure, a printer may include a housing having a first surface having a cassette mounting opening, a print head disposed in the housing and extending toward the cassette mounting opening from an inside of the housing, a platen roller disposed in the housing and facing the print head, and a printing cassette mountable on the housing by insertion to the cassette mounting opening in a first direction.

The printing cassette may have a first side-surface and a second side-surface overlapping each other in a second direction orthogonal to the first direction. In a state where the printing cassette is mounted on the housing, at least a portion of the first side-surface and at least a portion of the second side-surface do not overlap the housing in the second direction.

According to such a configuration, in a state where the printing cassette is mounted on the housing, the particular portion of the printing cassette is located outside the housing beyond the first surface. Thus, the printing cassette may be held and removed from the housing without a tab. As a result, an increase in cost of the printing cassette may be avoided.

DETAILED DESCRIPTION

1. First Illustrative Embodiment

[1-1. Configuration]

Figure 1A:
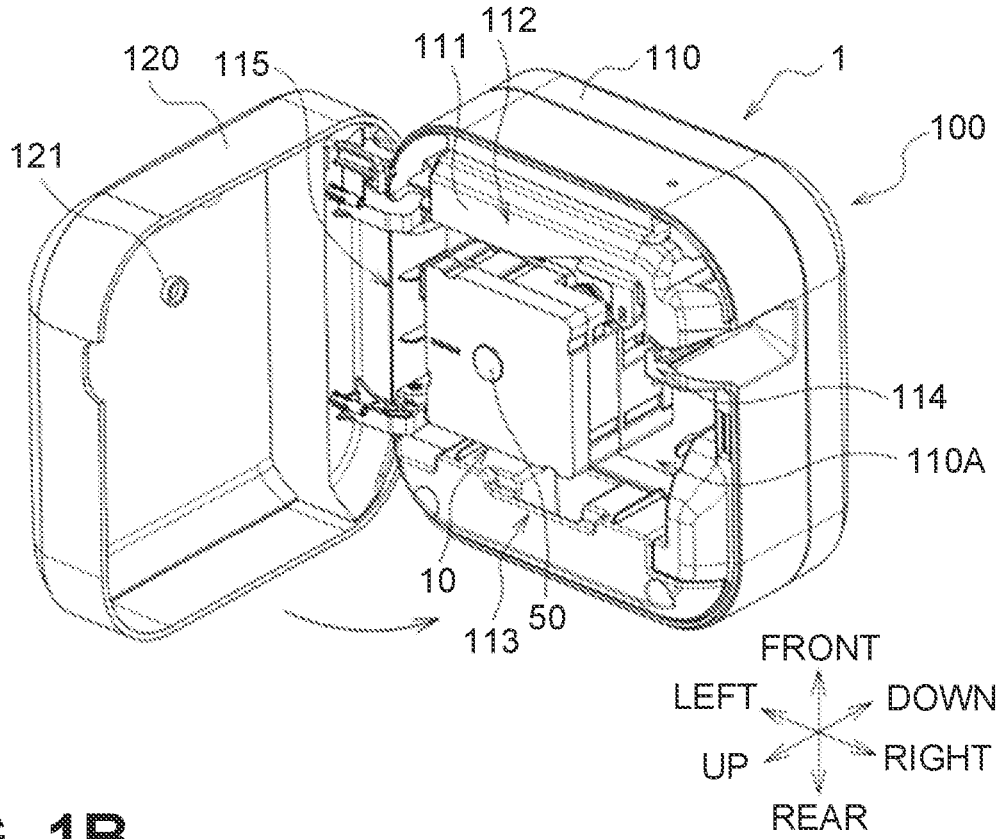
FIG. 1A is a schematic perspective view illustrating a state where a cover of a printer body is opened in a printer according to an illustrative embodiment.
Figure 1B:
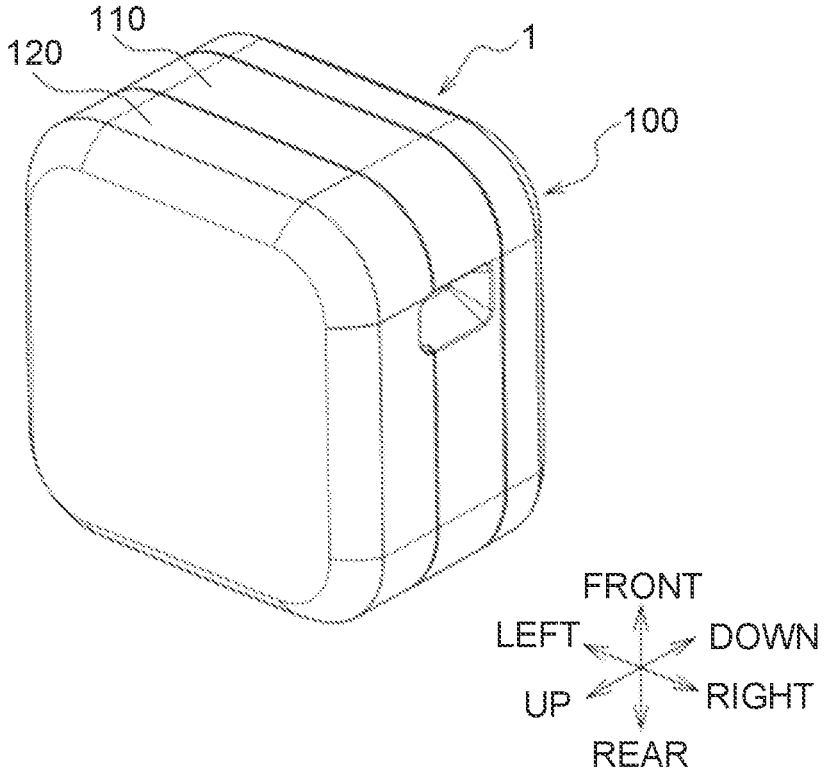
FIG. 1B is a schematic perspective view illustrating a state where the cover of the printer body is closed in the printer according to the illustrative embodiment.

A printer 1 illustrated in FIGS. 1A and 1B includes a printing cassette 10 and a printer body 100. The printer 1 is a device that performs printing on a tape-shaped printing medium.

In the illustrative embodiment, an axial direction of an output gear 18 of the printing cassette 10 and an axial direction of a platen gear 104 of the printer body 100 are defined as an up-down direction. A direction in which the output gear 18 and an input spool 16 are disposed side by side (i.e., a direction in which the platen gear 104 and a drive shaft 105 are disposed side by side) is referred to as a front-rear direction. A direction orthogonal to both the up-down direction and the front-rear direction is referred to as a left-right direction.

<Printer Body>

The printer body 100 includes a housing 110, a cover 120, and a pressing member 121 provided at the cover 120.

The housing 110 has a first surface 111 having a cassette mounting opening 110A. The first surface 111 constitutes an upper surface of the housing 110. The printing cassette 10 is configured to be placed in the housing 110 in a state where the cover 120 (refer to FIG. 1A) is opened.

The cover 120 is swingably attached to the housing 110. The cover 120 is configured to be openable and closable with respect to the housing 110 and cover the printing cassette 10 from the side opposite to the side where the housing 110 is disposed (i.e., from above). The cover 120 is in contact with the first surface 111 in the closed state.

In a state where the printing cassette 10 is placed in the housing 110, an upper end of the printing cassette 10, that is, an upper end of a pressed portion 50 in the illustrative embodiment, is located above the first surface 111.

In a state where the cover 120 is closed (refer to FIG. 1B), the pressing member 121 presses the printing cassette 10 downward in the housing 110. In the illustrative embodiment, as illustrated in FIG. 1B, a state where the printing cassette 10 is placed in the housing 110 and the cover 120 is closed may be defined as a state where the printing cassette 10 is mounted on the printer body 100.

Figure 2A:
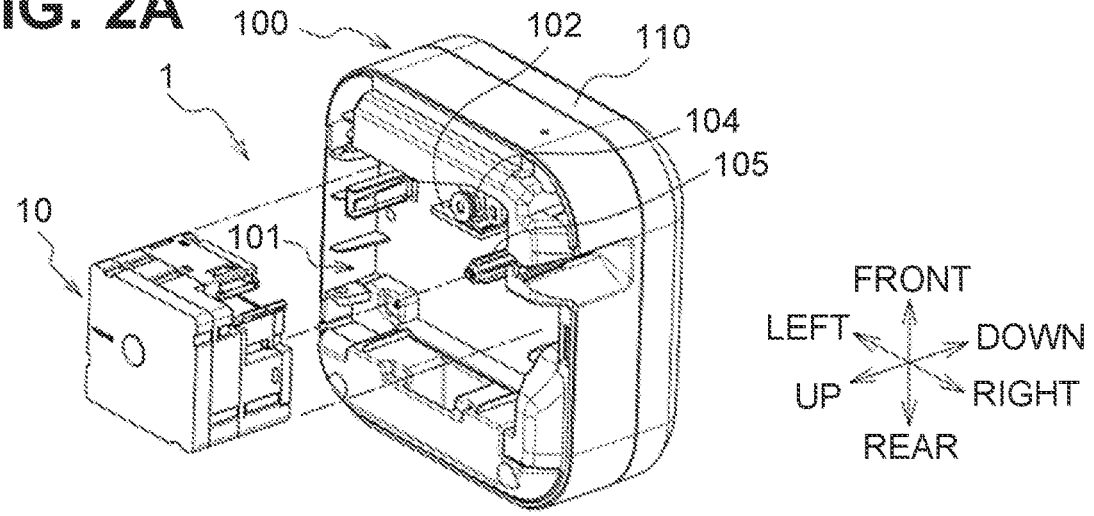
FIGS. 2A, 2B, and 2C are schematic perspective views each illustrating a state where a printing cassette is detached from the printer body in the printer according to the illustrative embodiment.
Figure 2B:
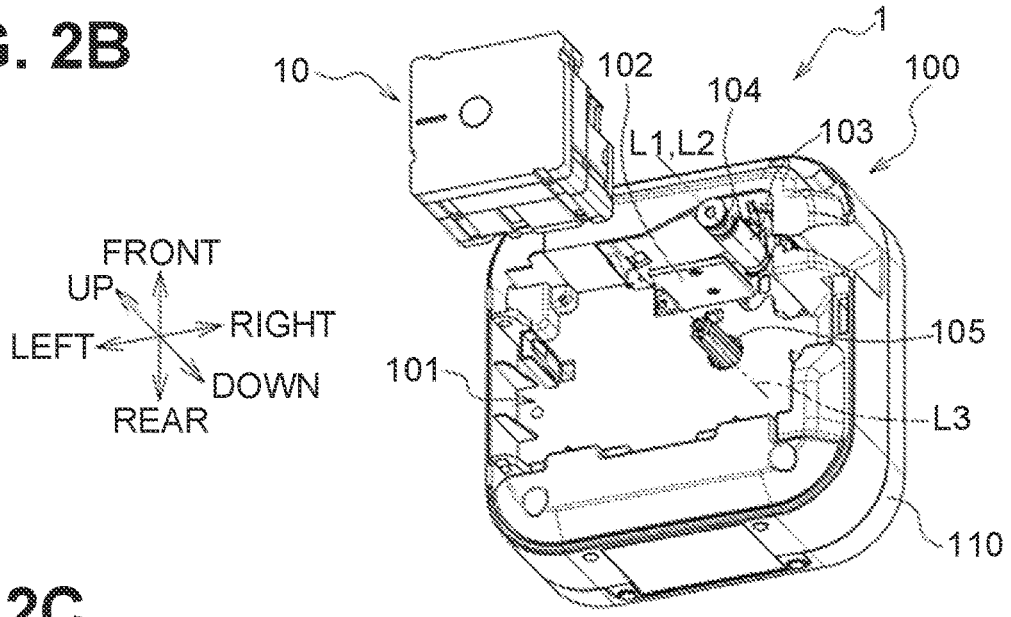
Figure 2C:
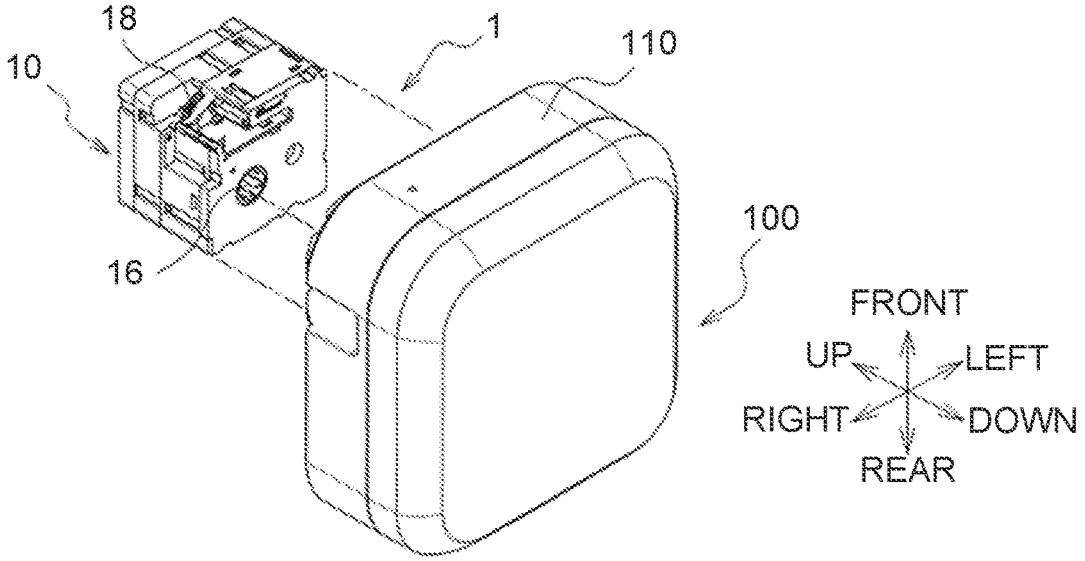

Further, as illustrated in FIGS. 2A, 2B, and 2C, the printer body 100 includes a cassette insertion portion 101, a print head 102, a platen roller 103, the platen gear 104, and the drive shaft 105.

(Cassette Insertion Portion)

The cassette insertion portion 101 may be a recessed portion where the printing cassette 10 is to be placed. The cassette insertion portion 101 has a function of positioning the printing cassette 10.

The cassette insertion portion 101 is provided at the housing 110. Specifically, the cassette insertion portion 101 defines a space into which a portion of the printing cassette 10 is to be inserted, together with the cassette mounting opening 110A. The cassette insertion portion 101 may be a portion of the first surface 111 recessed downward and overlapping the cassette mounting opening 110A.

(Print Head)

The print head 102 is disposed in the cassette insertion portion 101. The print head 102 has a plurality of heating elements, heat generation of which are individually controlled.

The print head 102 is a plate-shaped member disposed such that a thickness direction thereof is parallel to the front-rear direction. The print head 102 extends in the up-down direction from the inside of the housing 110 (i.e., the cassette insertion portion 101) toward the cassette mounting opening 110A.

(Platen Roller)

A rotation axis L1 of the platen roller 103 is parallel to the up-down direction. The platen roller 103 is disposed facing the print head 102 in the cassette insertion portion 101. The platen roller 103 is swingable in a direction toward or away from the print head 102.

(Platen Gear)

The platen gear 104 is coupled to the platen roller 103. In the illustrative embodiment, a rotation axis L2 of the platen gear 104 is coaxial with the rotation axis L1 of the platen roller 103. The platen gear 104 is swingable together with the platen roller 103.

(Drive Shaft)

The drive shaft 105 is to be inserted into the input spool 16. The drive shaft 105 rotates the input spool 16.

The drive shaft 105 is disposed in the cassette insertion portion 101. A rotation axis L3 of the drive shaft 105 is parallel to the up-down direction. The drive shaft 105 rotates about its rotation axis L3 by a driving source (e.g., a motor) (not illustrated).

<Printing Cassette>

The printing cassette 10 accommodates a printing medium. The printing cassette 10 is mountable to and removable from the printer body 100.

The printing cassette 10 is mountable to the housing 110 by insertion to the cassette mounting opening 110A in the up-down direction. Replacing the printing cassette 10 may achieve resupply of a printing medium and change of a type (e.g., color, material, or others) of the printing medium.

As illustrated in FIGS. 3A, 3B, 3C, 4A, and 4B, the printing cassette 10 includes a case 35 that accommodates a to-be-printed tape 11A, an ink ribbon 14A, and others, and the pressed portion 50. An outer shape of the printing cassette 10 (i.e., a shape of the case 35) may be a rectangular parallelepiped having sides parallel to the up-down direction, sides parallel to the front-rear direction, and sides parallel to the left-right direction.

The case 35 has a first side-surface 35A, a second side-surface 35B, a third side-surface 35C, and a fourth side-surface 35D. The first side-surface 35A constitutes a front surface of the printing cassette 10. The second side-surface 35B constitutes a rear surface of the printing cassette 10. The third side-surface 35C constitutes a right surface of the printing cassette 10. The fourth side-surface 35D constitutes a left surface of the printing cassette 10.

The first side-surface 35A and the second side-surface 35B are orthogonal to the front-rear direction and are located overlapping each other in the front-rear direction. The third side-surface 35C and the fourth side-surface 35D are orthogonal to the left-right direction and are located overlapping each other in the left-right direction.

The case 35 includes a first case portion 31, a first frame portion 32, a second frame portion 33, and a second case portion 34.

The pressed portion 50 may be a portion that receives a pressing force from the pressing member 121 of the printer body 100 in a state where the printing cassette 10 is mounted on the printer body 100. The pressed portion 50 is exposed through an opening 31B provided at the upper surface of the case 35.

Figure 5:
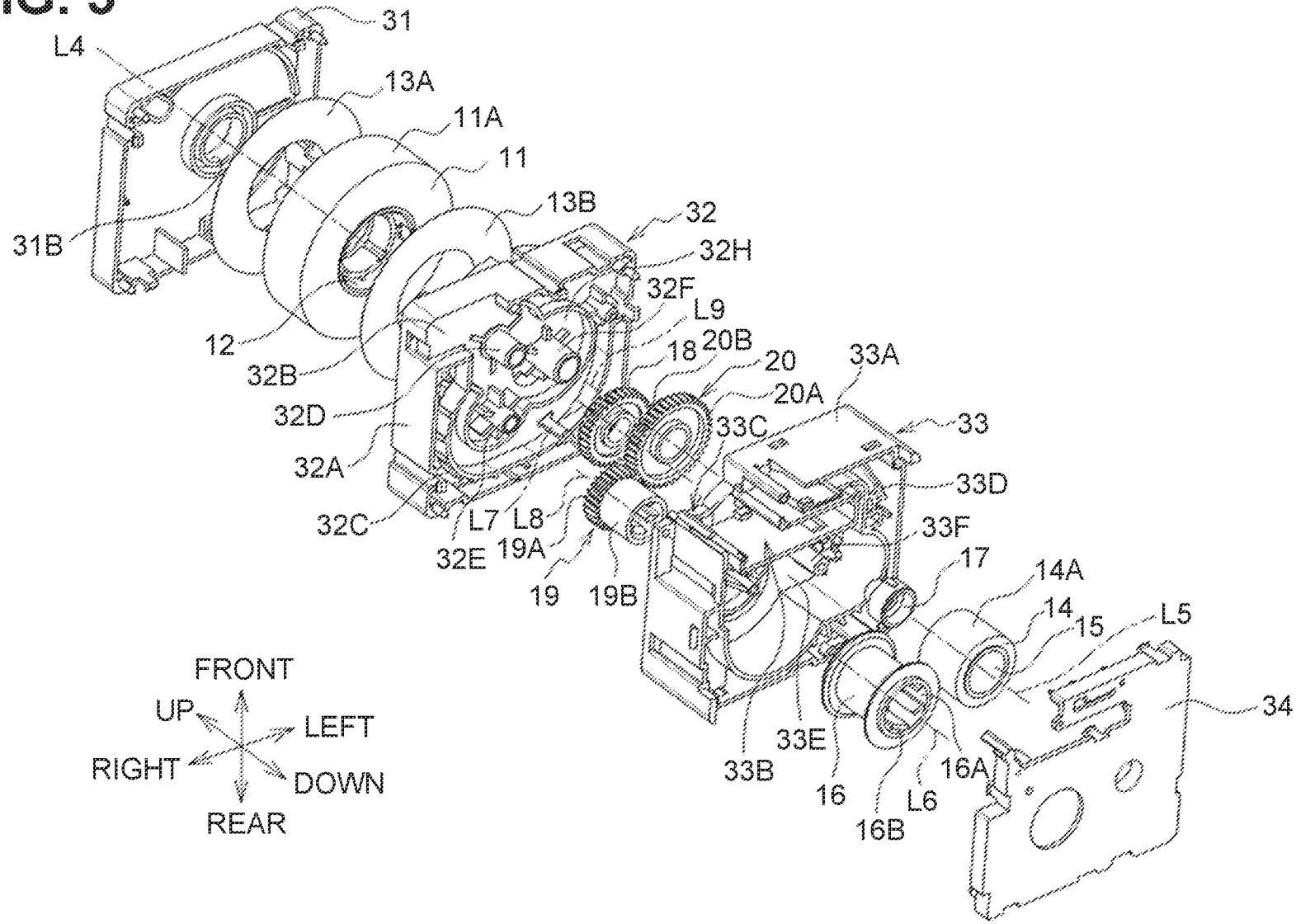
FIG. 5 is a disassembled schematic perspective view of the printing cassette of FIG. 3A.

As illustrated in FIG. 5, the printing cassette 10 includes a first roll 11, a first feed spool 12, a spacer film 13A, a spacer film 13B, a second roll 14, a second feed spool 15, an input spool 16, a clutch spring holder 17, the output gear 18, the input gear 19, and an idle gear 20.

(First Roll)

in the first roll 11, the to-be-printed tape 11A on which printing is to be performed is wound around the first feed spool 12. The first roll 11 has a cylindrical shape having a hollow portion that is defined by an inner peripheral surface of the to-be-printed tape 11A wound about its axis parallel to the up-down direction. Printing is performed on a surface of the to-be-printed tape 11A by the print head 102 of the printer body 100 and the ink ribbon 14A.

Two spacer films 13A, 13B are disposed outside the first roll 11 in the up-down direction such that the spacer films 13A, 13B sandwich the first roll 11 therebetween. The spacer film 13A is disposed between the first roll 11 and the first case portion 31. The spacer film 13B is disposed between the first roll 1I and the first frame portion 32.

(First Feed Spool)

The first feed spool 12 is rotatable about its rotation axis L4. The first feed spool 12 rotates along with conveyance of the to-be-printed tape 11A by the platen roller 103 of the printer body 100, thereby feeding the to-be-printed tape 11A to the print head 102.

(Second Roll)

In the second roll 14, the ink ribbon 14A used for printing on the to-be-printed tape 11A is wound around the second feed spool 15.

In a head opening 33B, the ink ribbon 14A is laid on the to-be-printed tape 11A and used for printing performed by the print head 102 therein. The ink ribbon 14A that has been used for printing is taken up by the input spool 16. A rotation resistance is applied to the second roll 14 by a clutch spring held by the clutch spring holder 17. The second roll 14 is disposed such that a portion thereof overlaps the first roll 11 in the up-down direction.

(Second Feed Spool)

The second feed spool 15 is rotatable about its rotation axis L5. The rotation axis L5 of the second feed spool 15 is parallel to the rotation axis L4 of the first feed spool 12, that is, parallel to the up-down direction.

The second feed spool 15 rotates along with take-up of the ink ribbon 14A by the input spool 16, thereby feeding the ink ribbon 14A to the print head 102.

(Input Spool)

The input spool 16 is rotatable about its rotation axis L6. The rotation axis L6 of the input spool 16 is parallel to the rotation axis L5 of the second feed spool 15.

The input spool 16 has a cylindrical shape having a hollow portion defined by its inner peripheral surface 16A. Spline teeth 16B are provided on the inner peripheral surface 16A of the input spool 16. The spline teeth 16B is to be coupled to the drive shaft 105 of the printer body 100. The input spool 16 is rotated by the drive shaft 105.

(Output Gear)

The output gear 18 may be a single gear for outputting, to the outside, a driving force for conveying the to-be-printed tape 11A.

Specifically, the output gear 18 outputs a driving force to the platen gear 104 of the printer body 100. A rotation axis L7 of the output gear 18 is parallel to the rotation axis L5 of the second feed spool 15. The output gear 18 overlaps a cover portion 32B in the up-down direction.

The output gear 18 is partially exposed to the head opening 33B. The output gear 18 is in engagement with the platen gear 104 at the head opening 33B in a state where the printing cassette 10 is mounted on the printer body 100.

The second feed spool 15, the output gear 18, and the first roll 11 are disposed in the order of the second feed spool 15, the input gear 18, and the first roll 11 in the up-down direction. That is, the output gear 18 is located between the second feed spool 15 and the first roll 11 in the up-down direction.

(Input Gear)

The input gear 19 is indirectly connected to the output gear 18 via the idle gear 20 and transmits, to the output gear 18, a driving force input thereto from the printer body 100.

The input gear 19 includes a gear 19A and a cylindrical spool 19B. The spool 19B is fixed to a surface of the gear 19A orthogonal to a rotation axis of the gear 19A and has spline teeth on an inner peripheral surface thereof. The gear 19A rotates integrally with the spool 19B by a driving force input to the spool 19B.

A rotation axis L8 of the input gear 19 (i.e., the rotation axis of the gear 19A and a rotation axis of the spool 19B) is coaxial with the rotation axis L6 of the input spool 16. A portion of the spool 19B is inserted in the input spool 16. The input spool 16, a portion of the input gear 19 (i.e., the gear 19A) and the first roll 11 are disposed in the order of the input spool 16, the portion of the input gear 19 (i.e., the gear 19A), and the first roll 11 in the up-down direction.

The rotation axis L8 of the input gear 19 is coaxial with the hollow portion of the input spool 16 in the up-down direction. Thus, the drive shaft 105 is inserted into the input spool 16 and the spool 19B of the input gear 19 simultaneously. As a result, although the input gear 19 is not directly coupled to the input spool 16, the input gear 19 is rotated by a driving source (i.e., the drive shaft 105) common to the input spool 16.

(Idle Gear)

The idle gear 20 is engaged with the input gear 19 and the output gear 18. The idle gear 20 transmits, to the output gear 18, a driving force input to the input gear 19.

The idle gear 20 may be a stepped gear in which a larger gear 20A engaged with the input gear 19 and a smaller gear 20B engaged with the output gear 18 are arranged coaxially. The smaller gear 20B has a diameter smaller than the larger gear 20A.

Further, the smaller gear 20B is disposed at a position closer to the first roll 11 than the larger gear 20A to the first roll 11 in the up-down direction (i.e., on an upper side). The idle gear 20 constitutes a deceleration mechanism that decelerates the driving force input to the input gear 19.

(Case)

The first case portion 31 serves as an upper end portion of the printing cassette 10. The first frame portion 32 is disposed below the first case portion 31 and is connected to the first case portion 31 in the up-down direction. The second frame portion 33 is disposed below the first frame portion 32 and is connected to the first frame portion 32 in the up-down direction. The second case portion 34 serves as a lower end portion of the printing cassette 10. The second case portion 34 is connected to the second frame portion 33 in the up-down direction.

The first case portion 31 and the first frame portion 32 accommodate the first roll 11. That is, the first roll 11 is disposed in a space surrounded by the first case portion 31 and the first frame portion 32.

The second case portion 34 and the second frame portion 33 accommodate the second roll 14, the second feed spool 15, and the input spool 16. That is, the second roll 14, the second feed spool 15, and the input spool 16 are disposed in a space surrounded by the second case portion 34 and the second frame portion 33.

A particular portion of the output gear 18, the input gear 19, and the idle gear 20 are disposed in a space surrounded by the first frame portion 32 and the second frame portion 33.

Figure 3A:
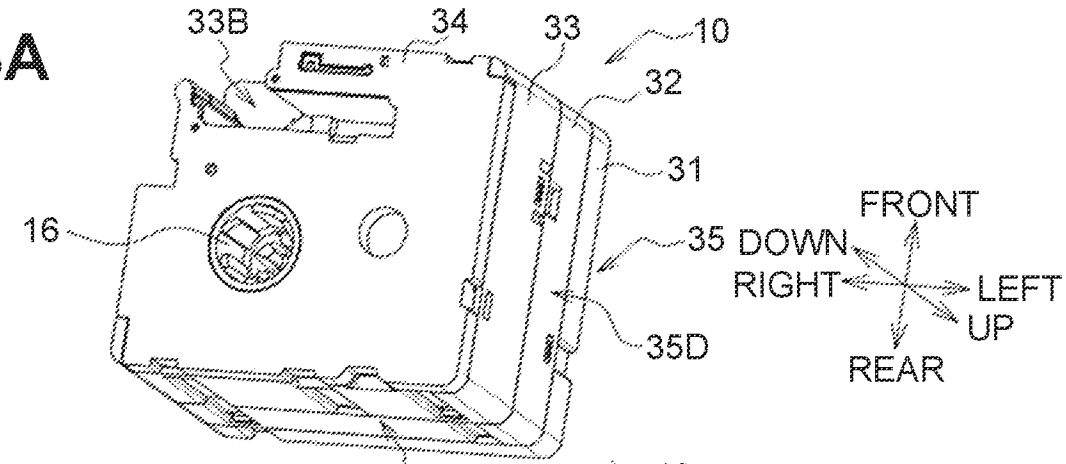
FIGS. 3A, 3B, and 3C are schematic perspective views each illustrating the printing cassette in the printer of FIG. 1A.
Figure 3C:
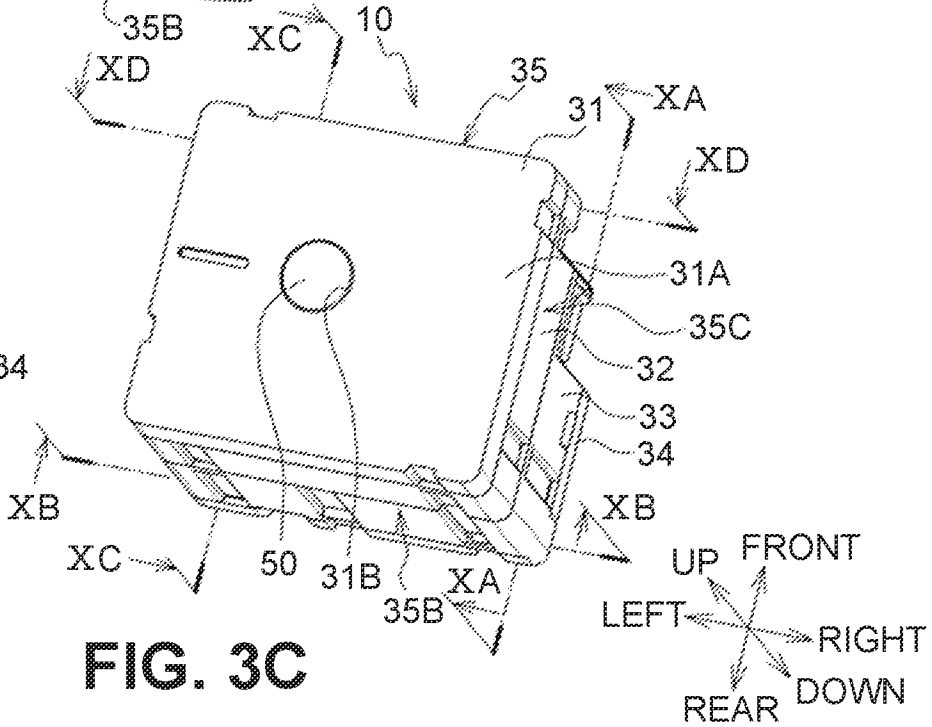
Figure 3B:
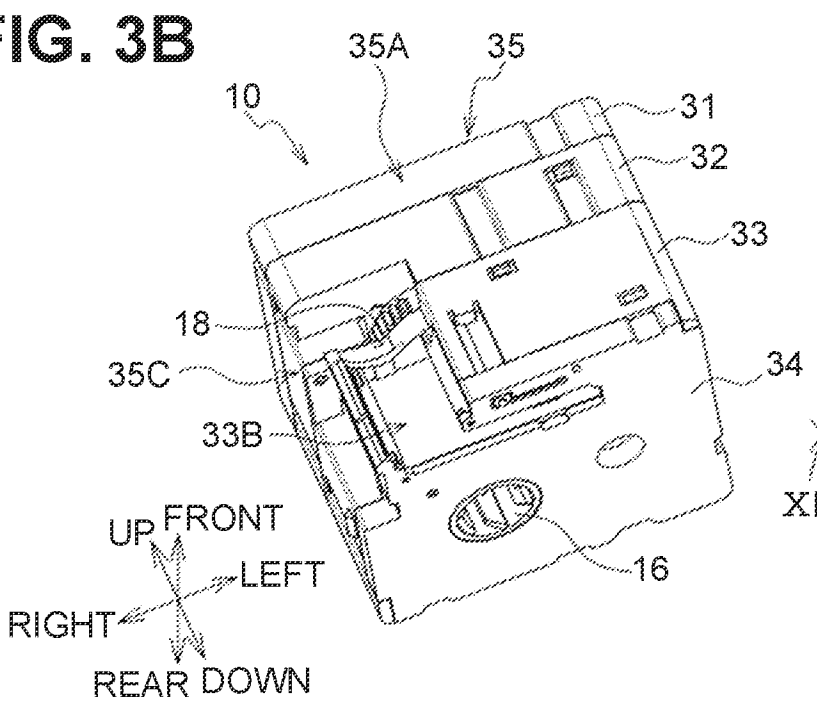
Figure 4A:
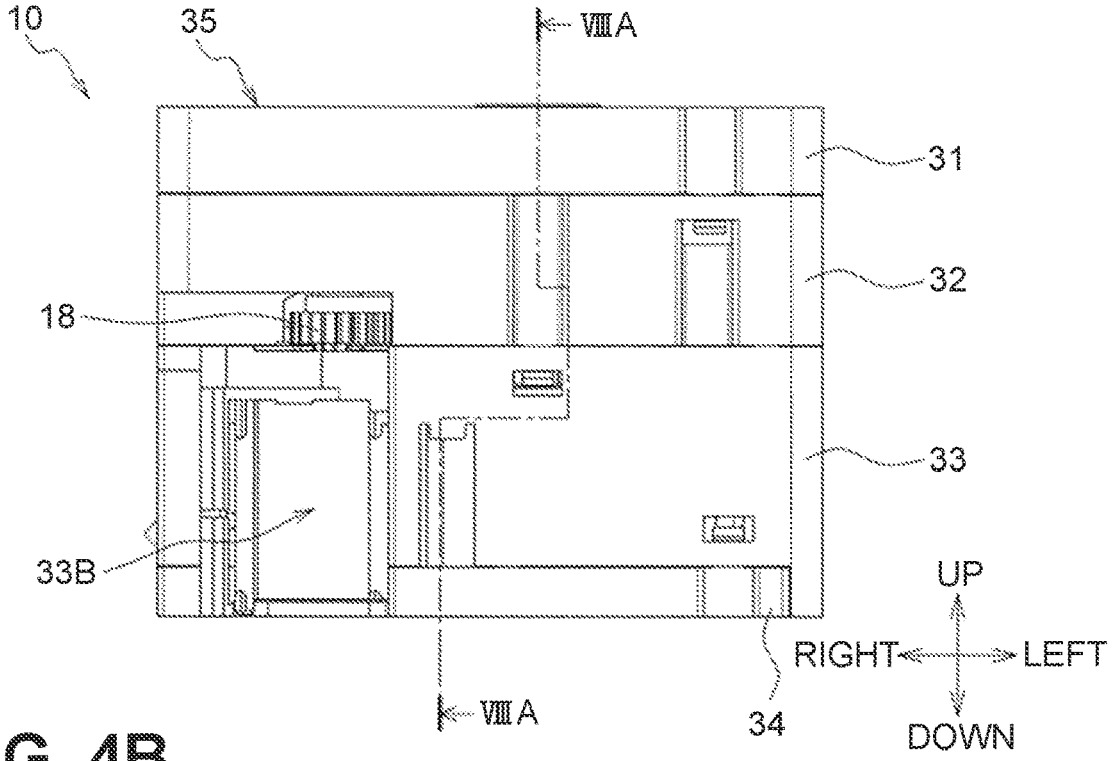
FIG. 4A is a schematic rear view of the printing cassette of FIG. 3A.
Figure 4B:
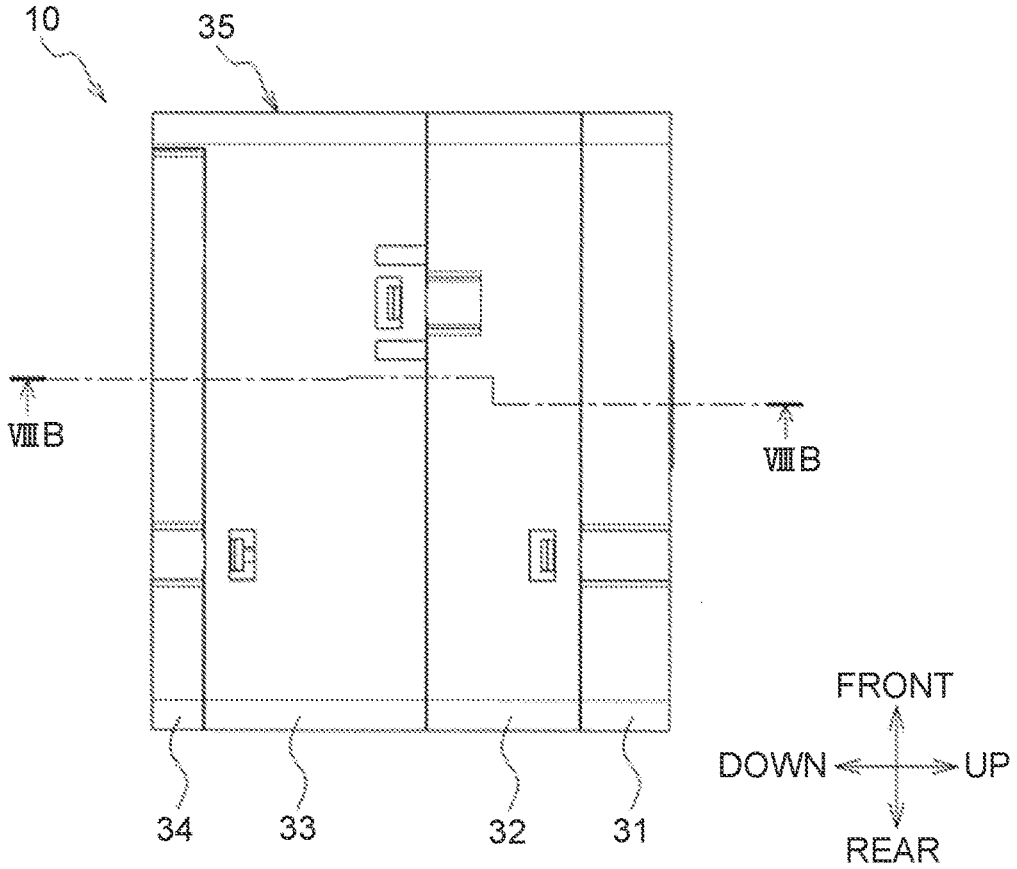
FIG. 4B is a schematic side view of the printing cassette of FIG. 3A.

As illustrated in FIG. 3C, the first case portion 31 has an obverse surface 31A and the opening 31B. The obverse surface 31A is orthogonal to the up-down direction. The opening 31B is provided at the obverse surface 31A. The pressed portion 50 penetrates the first case portion 31 in the up-down direction.

Figure 6A:
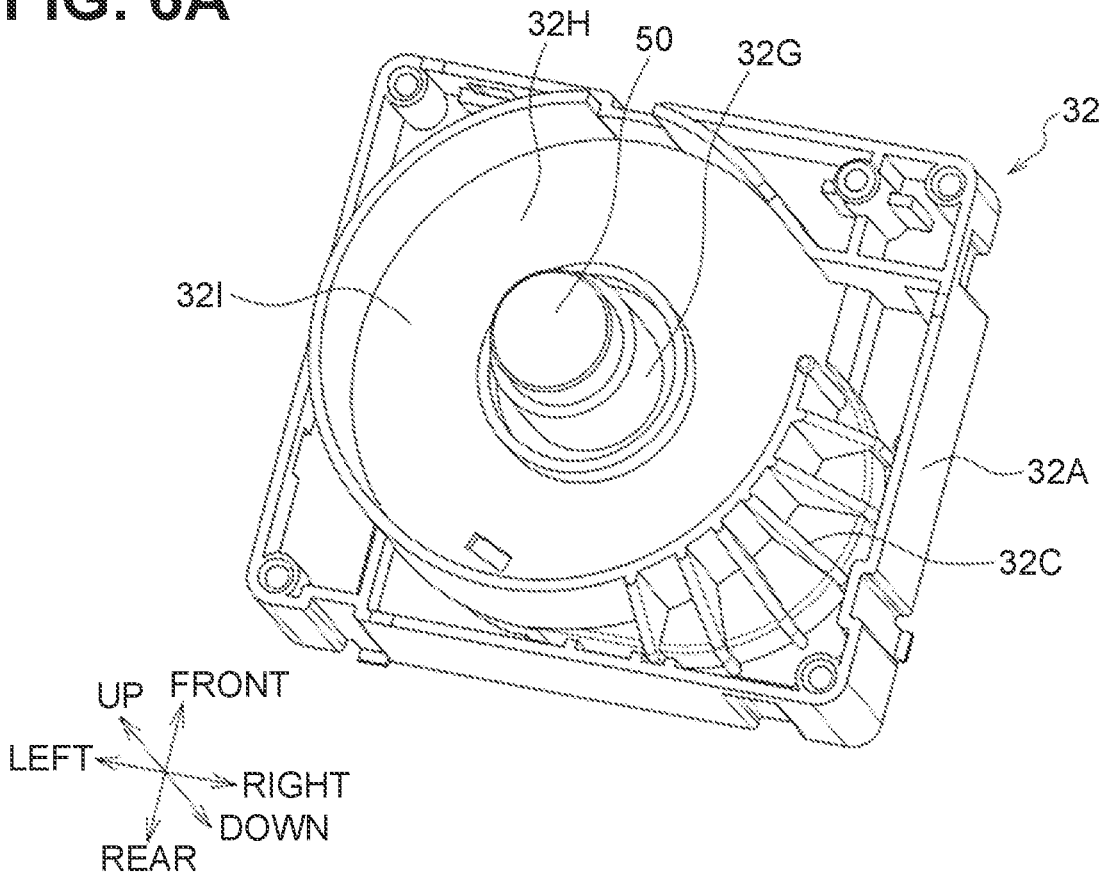
FIG. 6A is a schematic perspective view of a first frame portion of the printing cassette of FIG. 3A.

As illustrated in FIGS. 5 and 6A, the first frame portion 32 includes a first sidewall 32A, the cover portion 32B, a first guide 32C, a first gear shaft 32D, a second gear shaft 32E, a third gear shaft 32F, a connecting portion 32G, and a second support wall 32H.

The first sidewall 32A defines side surfaces of the printing cassette 10. The side surfaces of the printing cassette 10 extend parallel to the up-down direction.

The cover portion 32B has a surface orthogonal to the up-down direction. The cover portion 32B is disposed at a position where the cover portion 32B overlaps the output gear 18 in the up-down direction. In the illustrative embodiment, the cover portion 32B is disposed at a right front corner of the first frame portion 32.

The first gear shaft 32D supports the output gear 18 rotatably. The second gear shaft 32E supports the input gear 19 rotatably. The third gear shaft 32F supports the idle gear 20 rotatably. The first gear shaft 32D, the second gear shaft 32E, and the third gear shaft 32F each protrude downward from a lower surface of the second support wall 32H.

The connecting portion 32G connects between the third gear shaft 32F and the pressed portion 50 in the up-down direction. In the illustrative embodiment, the connecting portion 32G, the third gear shaft 32F, and the pressed portion 50 are integral with each other.

The second support wall 32H is disposed between the first case portion 31 and the first support wall 33E of the second frame portion 33 in the up-down direction. The second support wall 32H has a support surface 321 that supports the first roll 11 from the idle gear 20 side (i.e., from below) in the up-down direction.

Figure 7:
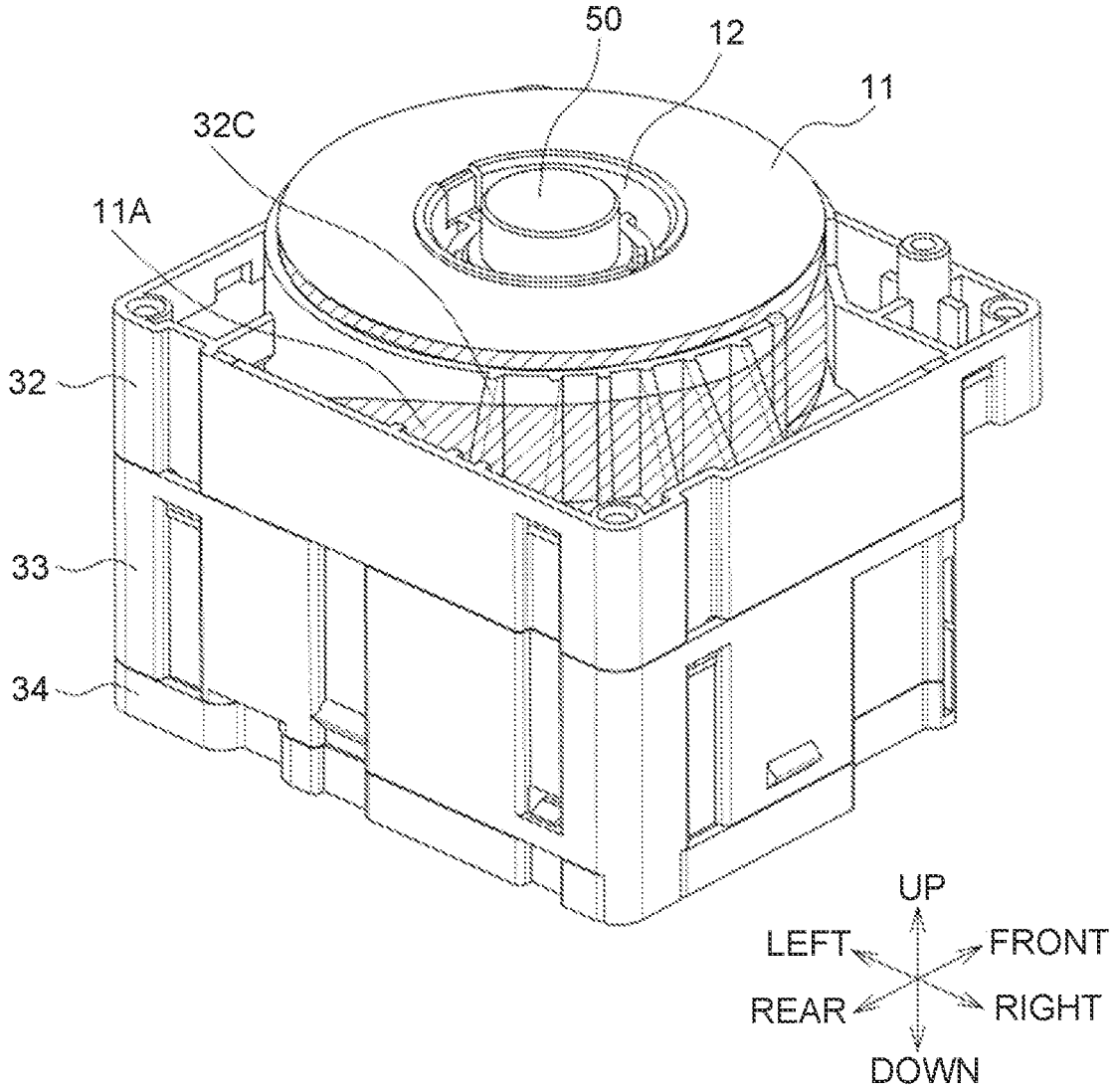
FIG. 7 is a schematic perspective view illustrating a state where a first case portion of the printing cassette of FIG. 3C is removed.

As illustrated in FIG. 7, the first guide 32C may be a portion around which the to-be-printed tape 11A drawn from the first roll 11 is wound. The first guide 32C has a plurality of ribs being plates that are apart from each other in a circumferential direction of the first roll 11. The plurality of ribs protrude in a radial direction of the first roll 11, and a protruding amount of each of the plurality of ribs (i.e., a plate width) increases as each of the plurality of ribs extends downward.

Figure 6B:
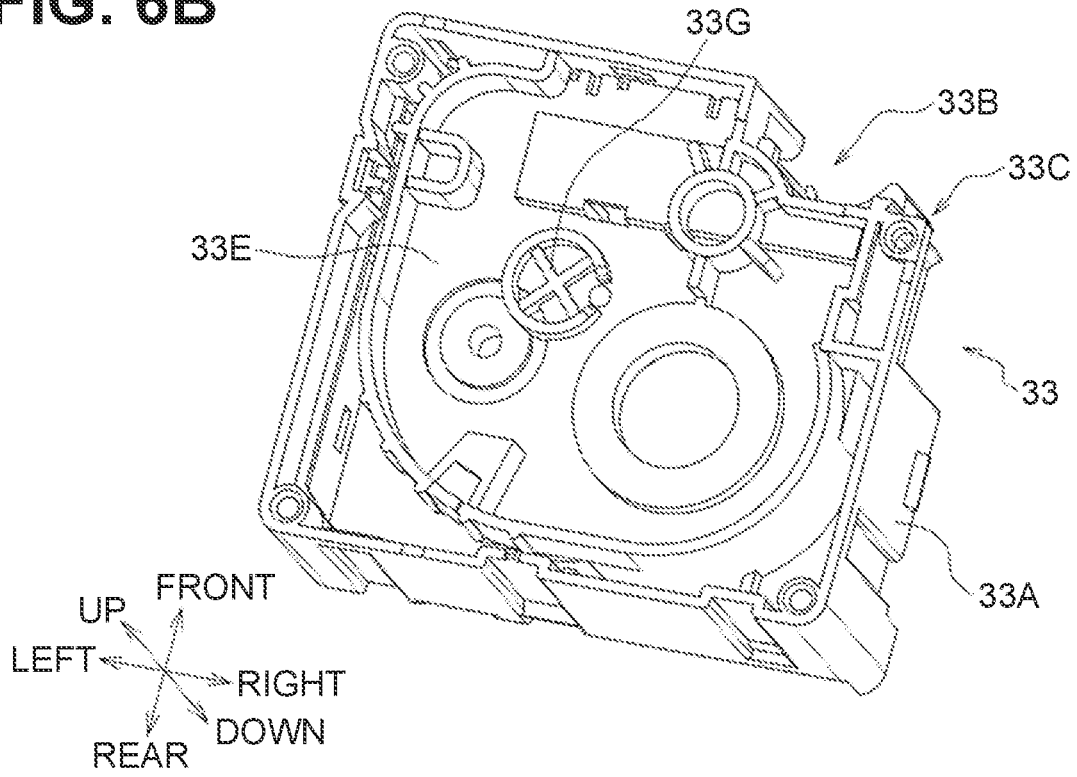
FIG. 6B is a schematic perspective view of a second frame portion of the printing cassette of FIG. 3A.

As illustrated in FIGS. 5 and 6B, the second frame portion 33 includes a second sidewall 33A, the head opening 33B, an outlet 33C, a second guide 33D, a first support wall 33E, and a restricting portion 33F.

The second sidewall 33A defines side surfaces of the printing cassette 10. The side surfaces of the printing cassette 10 extend parallel to the up-down direction.

The head opening 33B is a cutaway portion of the second sidewall 33A. The head opening 33B is a space in which the print head 102 is located by insertion into the head opening 33B from below in a state where the printing cassette 10 is mounted on the printer body 100. The head opening 33B opens downward in the printing cassette 10.

The second guide 33D is a portion around which the to-be-printed tape 11A that has passed the first guide 32C. As with the first guide 32C, the second guide 33D has a plurality of ribs being plates that are apart from each other in a circumferential direction of the second roll 14. The plurality of ribs protrude in a radial direction of the second roll 14, and a protruding amount of each of the plurality of ribs (i.e., a plate width) decreases as each of the plurality of ribs extends downward.

The first support wall 33E is disposed opposite to (i.e., below) the pressed portion 50 with respect to the idle gear 20 in the up-down direction. Further, the second case portion 34 is disposed opposite to the idle gear 20 with respect to the first support wall 33E in the up-down direction.

The first support wall 33E restricts downward movement of the third gear shaft 32F. As illustrated in FIG. 6B, the first support wall 33E has a protruding portion 33G. The protruding portion 33G may be a cross-shaped protrusion protruding upward.

A lower end of the third gear shaft 32F is slightly spaced from the protruding portion 33G. When a downward force is applied to the third gear shaft 32F, the third gear shaft 32F contacts the protruding portion 33G. In other words, when a downward force is applied to the third gear shaft 32F, the first support wall 33E supports the third gear shaft 32F from below and restricts a downward movement of the third gear shaft 32F.

As illustrated in FIG. 5, the restricting portion 33F is disposed between the first support wall 33E and the second case portion 34 in the up-down direction. The restricting portion 33F is disposed at a position where the restricting portion 33F overlaps the third gear shaft 32F in the up-down direction.

When a downward force is applied to the first support wall 33E, a lower end of the restricting portion 33F contacts the second case portion 34, whereby the restricting portion 33F restricts warping of the first support wall 33E in a direction toward the second case portion 34 (i.e., downward). The restricting portion 33F of the illustrative embodiment may be a cylinder that protrudes downward from the first support wall 33E and whose central axis is parallel to the up-down direction.

<Positional Relationship of Third Gear Shaft>

The third gear shaft 32F is inserted through the idle gear 20 and extends in the up-down direction parallel to a rotation axis L9 of the idle gear 20.

Figure 8A:
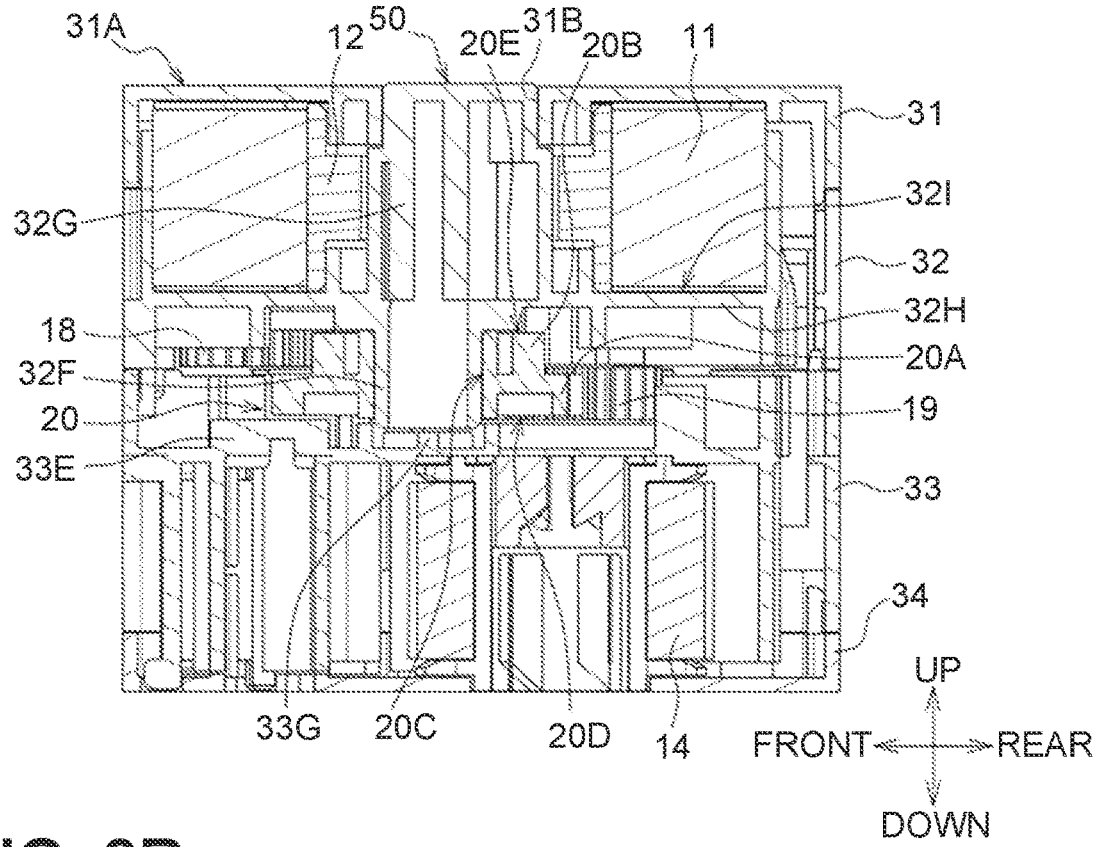
FIG. 8A is a schematic cross-sectional view taken along line VIIIA-VIIIA of FIG. 4A.
Figure 8B:
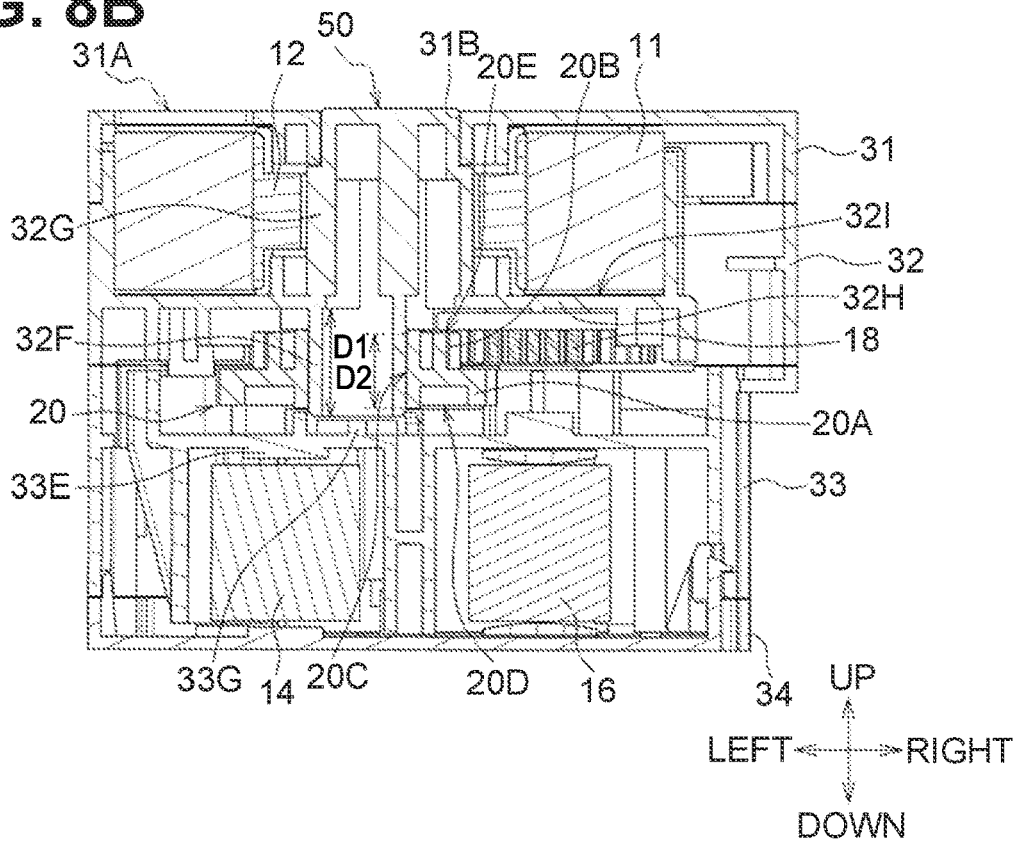
FIG. 8B is a schematic cross-sectional view taken along line VIIIB-VIIIB of FIG. 4B.

As illustrated in FIGS. 8A and 8B, the idle gear 20 has a sliding portion 20C, a first surface 20D, and a second surface 20E. The third gear shaft 32F is inserted in the sliding portion 20C and slides therein. The first surface 20D and the second surface 20E are orthogonal to the up-down direction. The first surface 20D may be a lower surface of the larger gear 20A. The second surface 20E may be an upper surface of the smaller gear 20B and is farther from the first support wall 33E than the first surface 20D from the first support wall 33E.

A dimension D1 of the third gear shaft 32F in the up-down direction is greater than a dimension D2 of the sliding portion 20C of the idle gear 20 in the up-down direction. The dimension D1 of the third gear shaft 32F in the up-down direction refers to a distance from a proximal end of the third gear shaft 32F (i.e., a portion connected to the second support wall 32H) to a distal end of the third gear shaft 32F.

The third gear shaft 32F penetrates both the first surface 20D and the second surface 20E of the idle gear 20. That is, the third gear shaft 32F protrudes downward relative to the second surface 20E of the idle gear 20.

The first roll 11 is disposed offset to the pressed portion 50 and at a position farther from the first support wall 33E than the idle gear 20 from the first support wall 33E in the up-down direction (i.e., a position closer to the pressed portion 50 than the idle gear 20 to the pressed portion 50). Further, at least a portion of the third gear shaft 32F overlaps the hollow portion of the first roll 11 in the up-down direction.

At least a portion of the connecting portion 32G overlaps the hollow portion of the first roll 11 in the left-right direction and the front-rear direction. Further, the first roll 11 and the first feed spool 12 are disposed around the connecting portion 32G. That is, the connecting portion 32G constitutes a shaft of the first feed spool 12.

The pressed portion 50 is disposed at a position closer to the obverse surface 31A of the first case portion 31 than the support surface 321 to the obverse surface 31A in the up-down direction. Further, the pressed portion 50 overlaps the opening 31B in the up-down direction. In the illustrative embodiment, the pressed portion 50 protrudes slightly above the obverse surface 31A.

Figure 9:
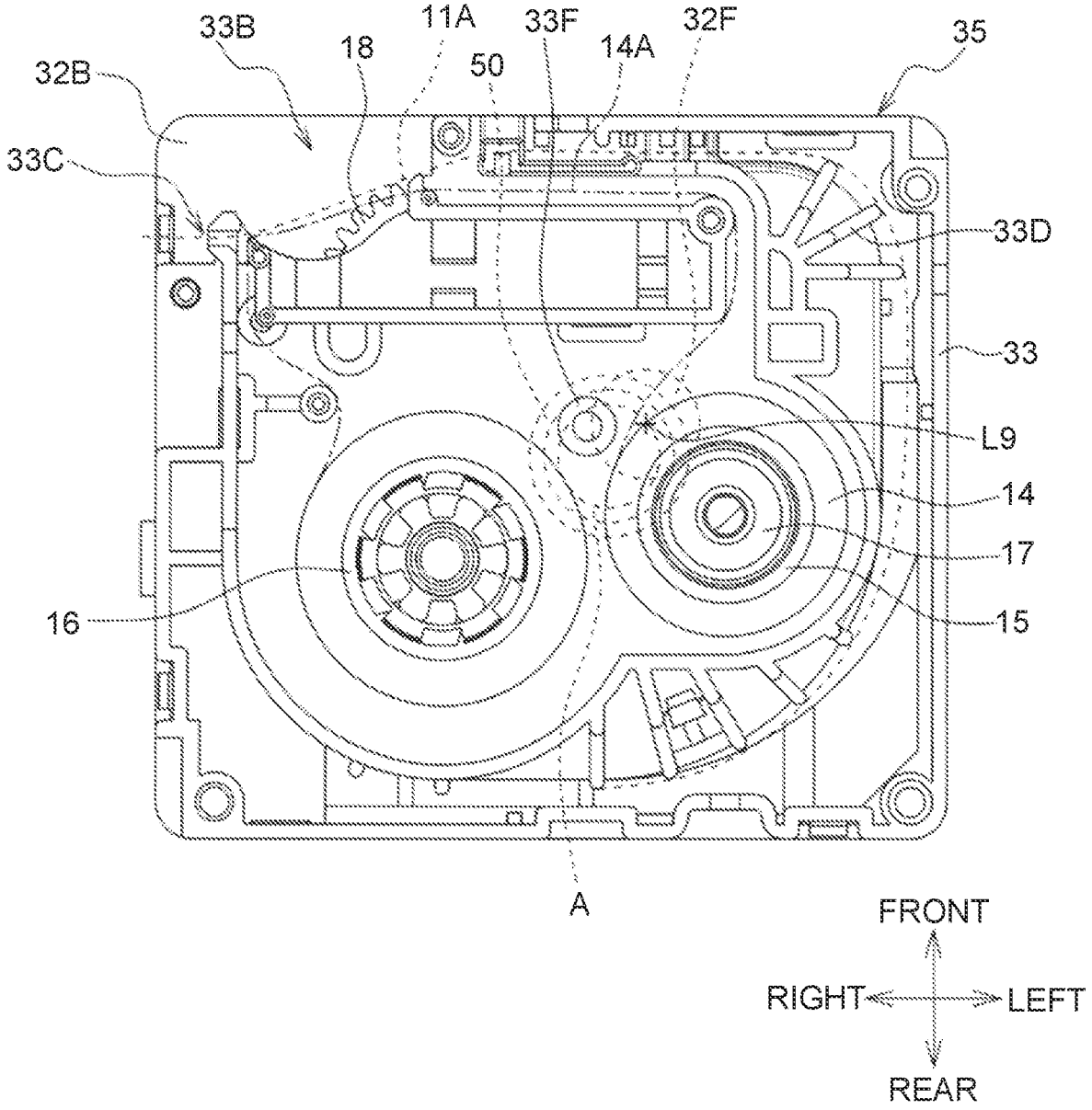
FIG. 9 is a perspective view for explaining a path of a to-be-printed tape and a path of an ink ribbon in the printing cassette of FIG. 3A.

As illustrated in FIG. 9, the third gear shaft 32F overlaps at least a portion of the pressed portion 50 in the up-down direction. Further, the rotation axis L9 of the idle gear 20 passes through the pressed portion 50.

At least a portion of a contact area A where the pressed portion 50 and the pressing member 121 are contacted with each other (i.e., an area where an external member that transmits a pressing force to the pressed portion 50 contacts the pressed portion 50) overlaps the third gear shaft 32F in the up-down direction. In the illustrative embodiment, the pressing member 121 has a cylindrical shape. Thus, the contact area A is circular.

Further, at least a portion of the pressed portion 50 overlaps the restricting portion 33F in the up-down direction. At least a portion of the restricting portion 33F overlaps the third gear shaft 32F in the up-down direction.

<Conveyance of Tape>

As illustrated in FIG. 9, the to-be-printed tape 11A and the ink ribbon 14A extend across the head opening 33B in the right-left direction. The to-be-printed tape 11A on which printing has been performed is discharged to the outside of the printer 1 from the outlet 33C. A portion of the output gear 18 is located in the head opening 33B. Further, the cover portion 32B is exposed to the head opening 33B.

As illustrated in FIGS. 10A, 10B, 10C, and 10D, the first guide 32C and the second guide 33D define a path through which the to-be-printed tape 11A constituting the first roll 11 is fed from the first frame portion 32 to the second frame portion 33.

Figure 10A:
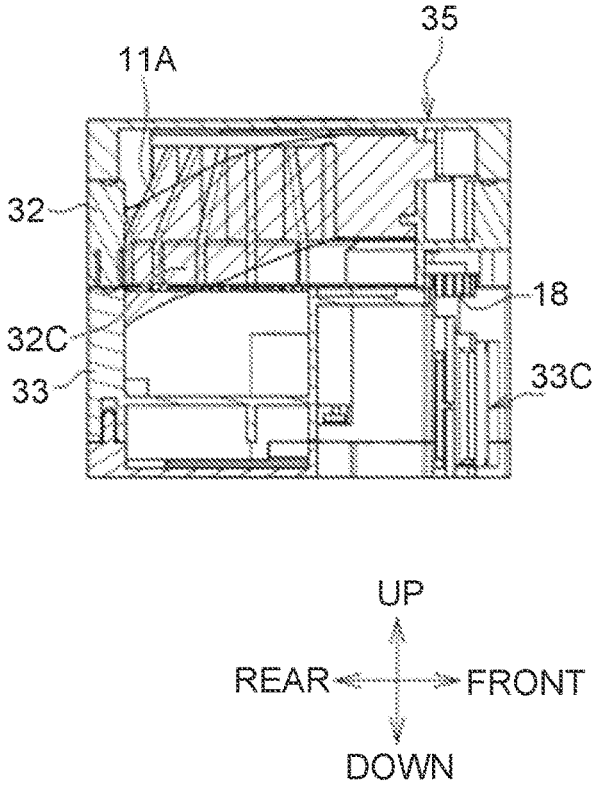
FIG. 10A is a schematic cross-sectional view taken along line XA-XA of FIG. 3C.
Figure 10B:
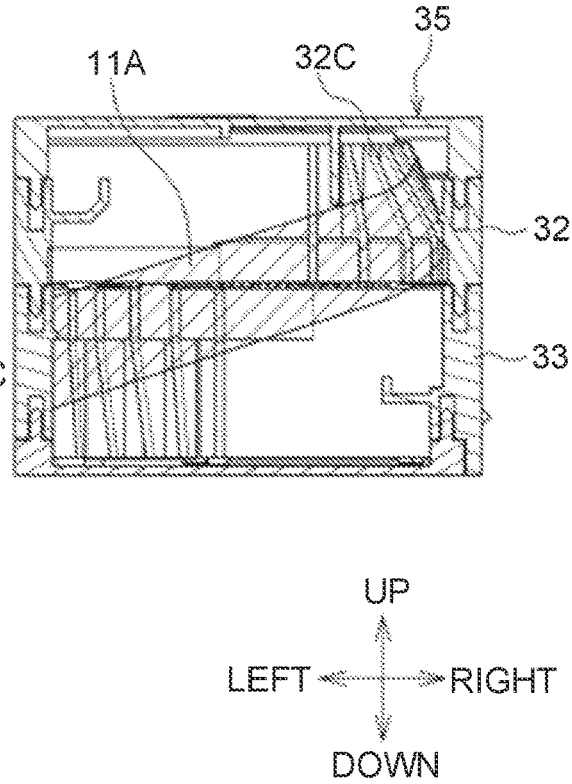
FIG. 10B is a schematic cross-sectional view taken along line XB-XB of FIG. 3C.

Specifically, as illustrated in FIG. 10A, the to-be-printed tape 11A drawn from the first roll 11 is conveyed in a spiral manner toward the lower rear in the first frame portion 32 while contacting the first guide 32C from an outer side in the radial direction of the first roll 11. As illustrated in FIG. 10B, the to-be-printed tape 11A is further conveyed toward the lower left while extending across a connected portion of the first frame portion 32 and the second frame portion 33 in the up-down direction.

Figure 10C:
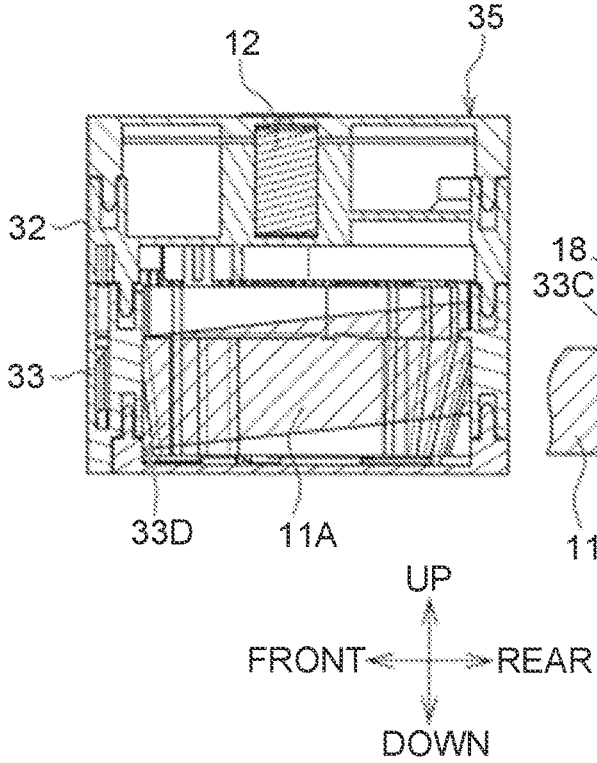
FIG. 10C is a schematic cross-sectional view taken along line XC-XC of FIG. 3C.
Figure 10D:
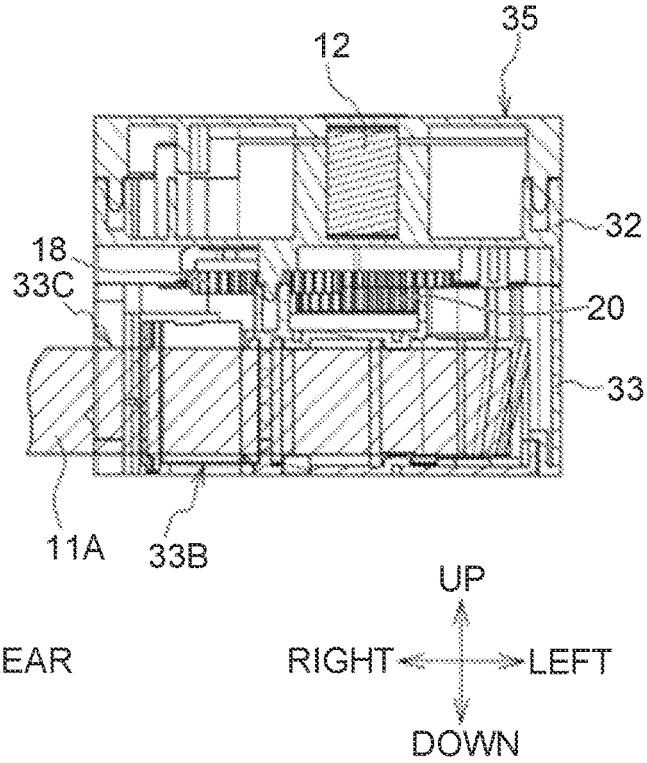
FIG. 10D is a schematic cross-sectional view taken along line XD-XD of FIG. 3C.

As illustrated in FIG. 10C, the to-be-printed tape 11A that has reached the second frame portion 33 is conveyed toward the lower front with contacting the second guide 33D from the outer side in the radial direction. As illustrated in FIG. 10D, the to-be-printed tape 11A that has reached the lower end portion of the printing cassette 10 passes the head opening 33B and is then discharged from the outlet 33C.

<Tape Conveyance and Printing by Printer Body>

The print head 102 performs printing on the to-be-printed tape 11A held by the printing cassette 10.

The print head 102 is disposed such that, in a state where the printing cassette 10 is mounted on the printer body 100, the print head 102 overlaps the to-be-printed tape 11A and the ink ribbon 14A in the front-rear direction at the head opening 33B.

The to-be-printed tape 11A that has been conveyed to the head opening 33B by the platen roller 103 is pressed toward the print head 102 in which the heating elements have generated heat, via the ink ribbon 14A. Thus, some ink on a particular surface of the ink ribbon 14A is transferred onto the to-be-printed tape 11A, and characters, symbols, and other representations are printed on the to-be-printed tape 11A.

The platen roller 103 conveys the to-be-printed tape 11A from the inside to the outside of the printing cassette 10. The platen roller 103 contacts and presses the to-be-printed tape 11A toward the print head 102 at the head opening 33B.

Figure 11:
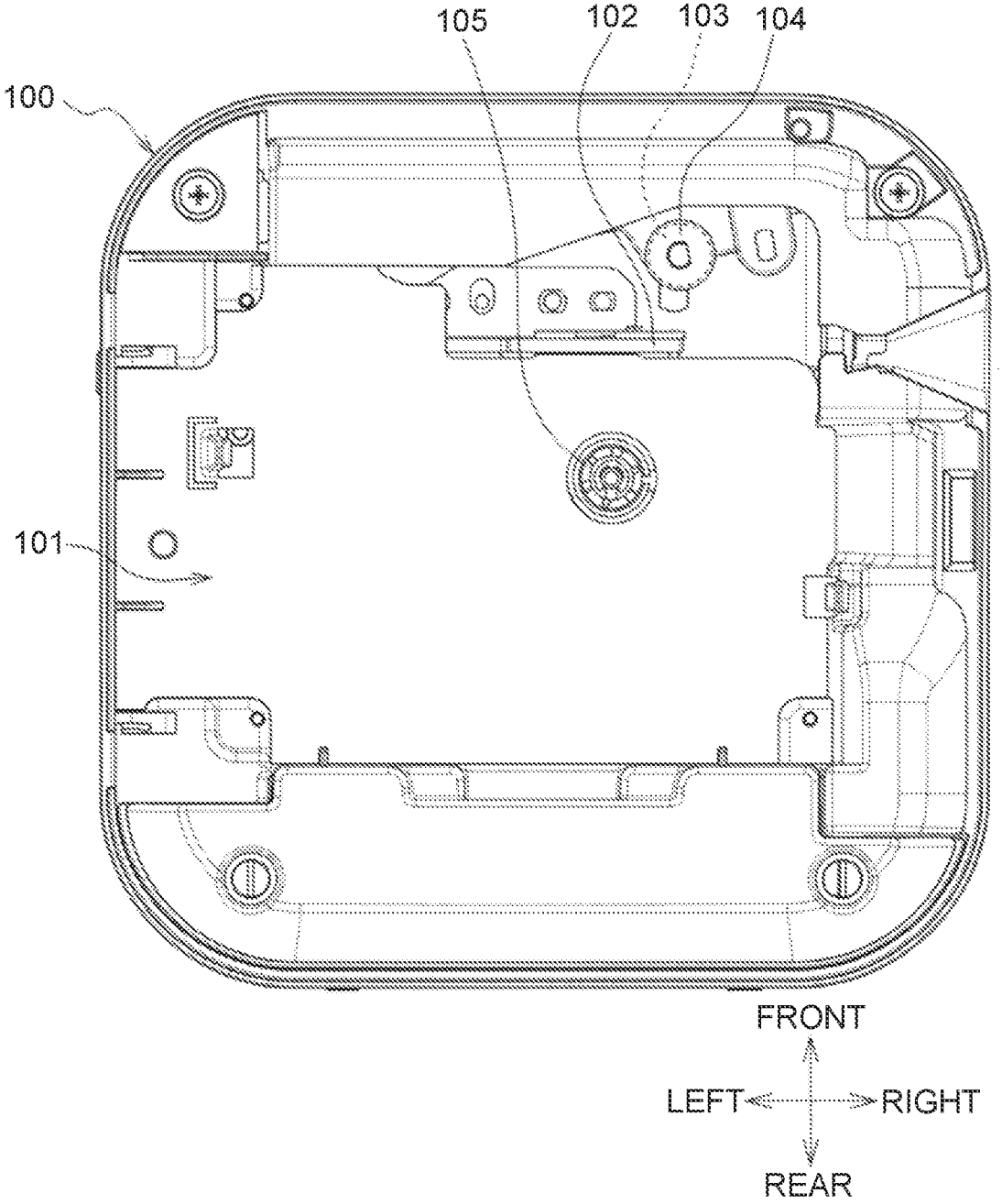
FIG. 11 is a schematic plan view illustrating the printer body of the printer of FIG. 1A.

The platen gear 104 is connected to the platen roller 103 and is to be engaged with the output gear 18. The platen roller 103 and the platen gear 104 are swingable between a position illustrated in FIG. 11 where the platen roller 103 and the platen gear 104 are spaced from the printing cassette 10 and a position illustrated in FIG. 12 where the platen gear 104 is in engagement with the output gear 18.

The drive shaft 105 is engaged with the input gear 19 when the drive shaft 105 is inserted into the input spool 16, and rotates the input spool 16 and the input gear 19.

Figure 12:
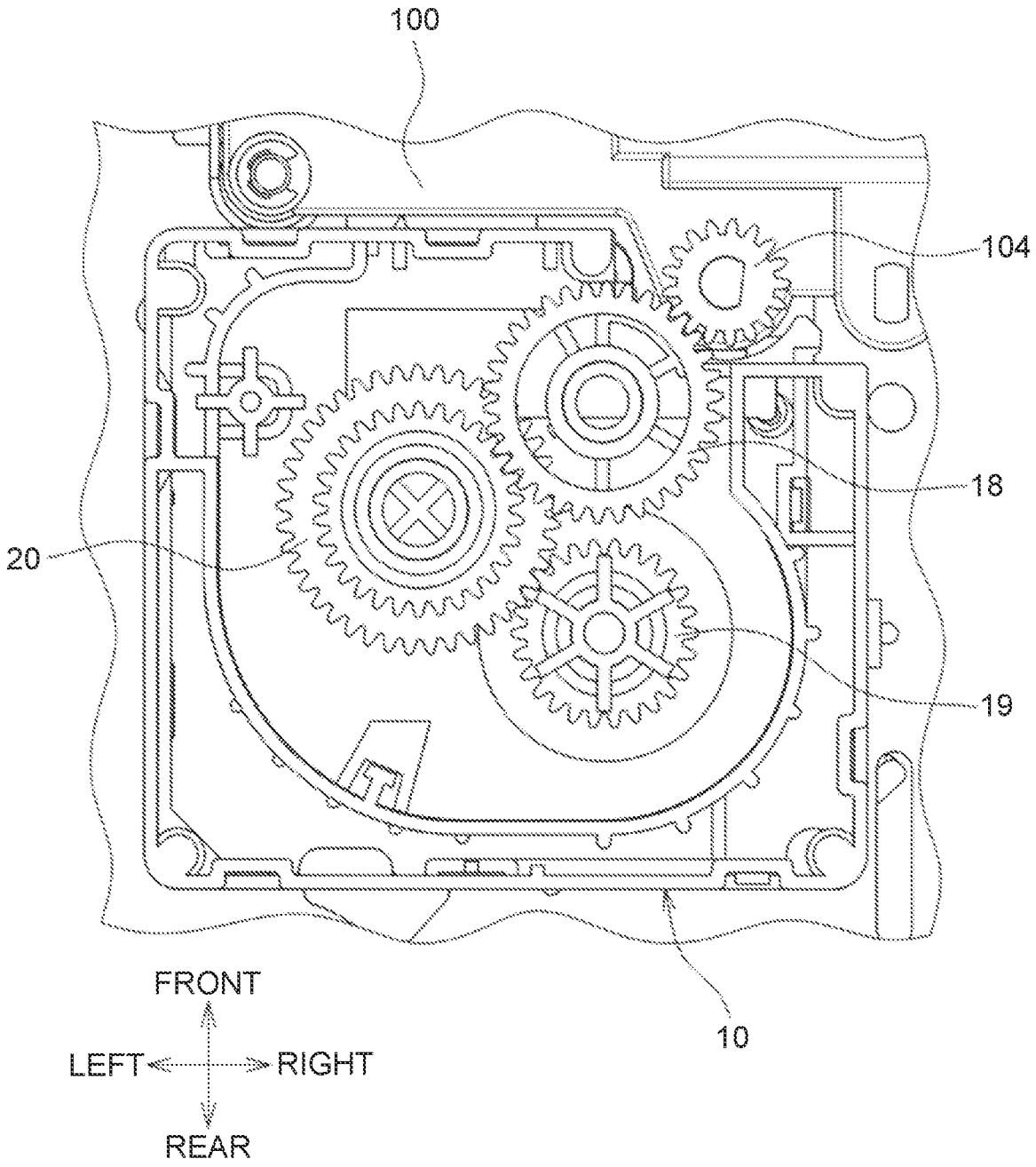
FIG. 12 is a schematic view illustrating a state where an output gear and a platen gear are in engagement with each other in the printer of FIG. 1A.

As illustrated in FIG. 12, in a state where the printing cassette 10 is mounted on the printer body 100, the drive shaft 105 is in engagement with the input gear 19 and the platen gear 104 is in engagement with the output gear 18. Specifically, the drive shaft 105 is inserted into the input spool 16 and the input gear 19 of the printing cassette 10. Thereafter, the platen roller 103 and the platen gear 104 are swung toward the head opening 33B of the printing cassette 10.

As the input gear 19 is rotated by the drive shaft 105 in a state where the printing cassette 10 is mounted, the output gear 18 is rotated, the platen gear 104 is rotated by the rotation of the output gear 18, and the platen roller 103 is rotated by the rotation of the platen gear 104.

<Positional Relationship Between Printing Cassette and Housing>

As illustrated in FIGS. 13A, 13B, 13C, 13D, and 13E, the first surface 111 of the housing 110 has a first area 112, a second area 113, a third area 114, and a fourth area 115, each of which is adjacent to the cassette mounting opening 110A.

The first area 112 is located further to the front than the cassette mounting opening 110A. The second area 113 is located further to the rear than the cassette mounting opening 110A. That is, the second area 113 is located across the cassette mounting opening 110A from the first area 112 in the front-rear direction.

The third area 114 is located further to the right than the cassette mounting opening 110A. The fourth area 115 is located further to the left than the cassette mounting opening 110A. That is, the fourth area 115 is located across the cassette mounting opening 110A from the third area 114 in the right-left direction. The third area 114 and the fourth area 115 are located between the first area 112 and the second area 113 in the front-rear direction.

The first area 112, the second area 113, the third area 114, and the fourth area 115 of the first surface 111 constitute a peripheral area surrounding the cassette mounting opening 110A around a central axis parallel to the up-down direction. The first area 112, the second area 113, the third area 114, and the fourth area 115 are located upstream from (i.e., above) the print head 102 in a direction in which the printing cassette 10 is mounted to the housing 110.

Figures 13A, 13B, 13C, 13D, 13E:
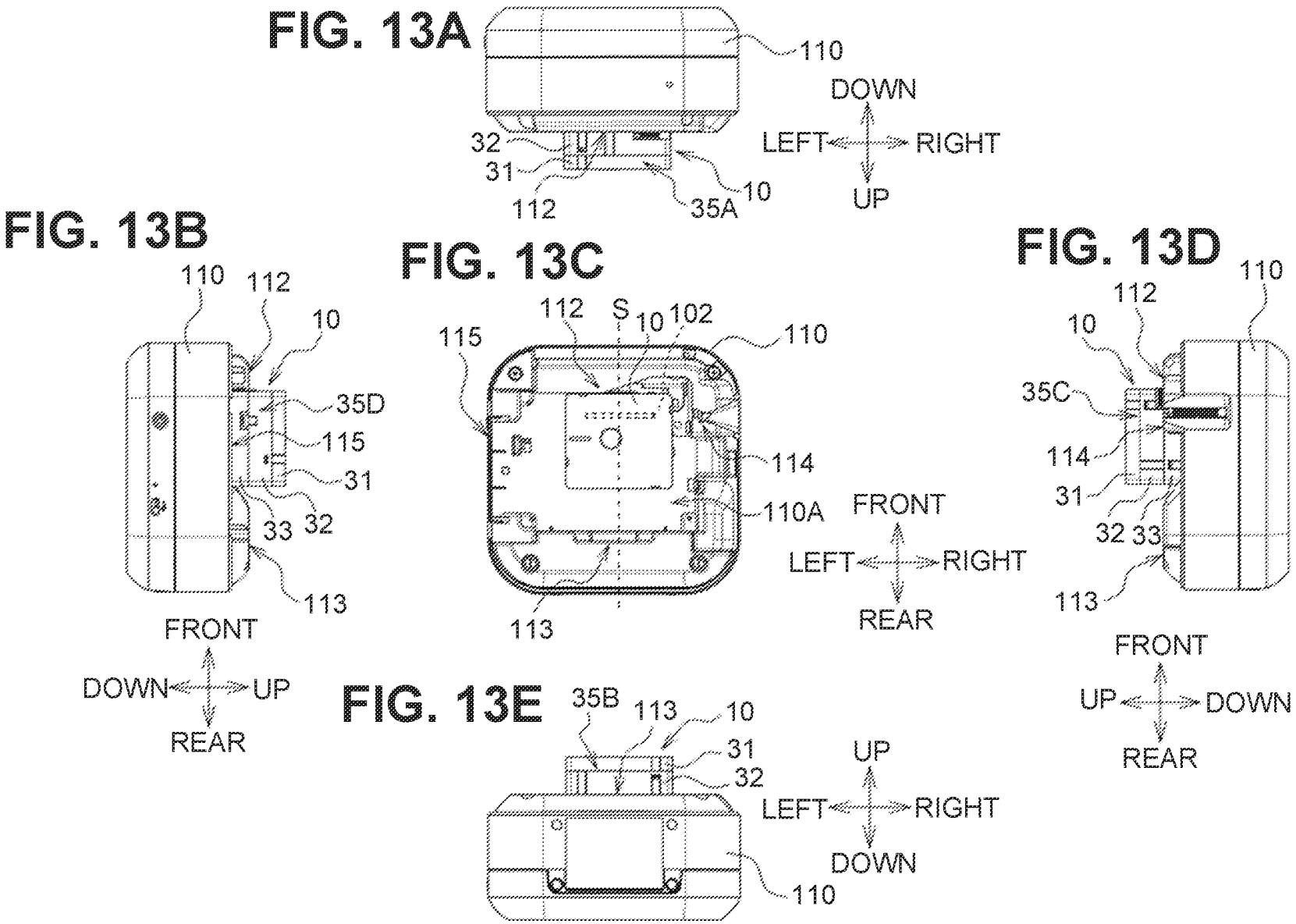
FIG. 13A is a schematic front view illustrating a state where the printing cassette is mounted on the housing of the printer of FIG. 1A.
FIG. 13B is a schematic left side view illustrating a state where the printing cassette is mounted on the housing of the printer of FIG. 1A.
FIG. 13C is a schematic plan view illustrating a state where the printing cassette is mounted on the housing of the printer of FIG. 1A.
FIG. 13D is a schematic left side view illustrating a state where the printing cassette is mounted on the housing of the printer of FIG. 1A.
FIG. 13E is a schematic rear view illustrating a state where the printing cassette is mounted on the housing of the printer of FIG. 1A.

As illustrated in FIG. 13C, the first area 112, the second area 113, and the print head 102 are located at respective positions such that a virtual plane S extending parallel to the first direction passes through the first area 112, the second area 113, and the print head 102, the virtual plane.

As illustrated in FIG. 13A, in a state where the printing cassette 10 is mounted on the housing 110, a particular portion of the printing cassette 10 adjacent to the first area 112 (i.e., the first side-surface 35A of the case 35) is located outside (i.e., above) the housing 110 beyond the first area 112 in the up-down direction.

As illustrated in FIG. 13E, in a state where the printing cassette 10 is mounted on the housing 110, another particular portion of the printing cassette 10 adjacent to the second area 113 (i.e., the second side-surface 35B of the case 35) is located outside (i.e., above) the housing 110 beyond the second area 113 in the up-down direction.

As illustrated in FIG. 13D, in a state where the printing cassette 10 is mounted on the housing 110, another particular portion of the printing cassette 10 adjacent to the third area 114 (i.e., the third side-surface 35C of the case 35) is located outside (i.e., above) the housing 110 beyond the third area 114 in the up-down direction.

As illustrated in FIG. 13B, in a state where the printing cassette 10 is mounted on the housing 110, another particular portion of the printing cassette 10 adjacent to the fourth area 115 (i.e., the fourth side-surface 35D of the case 35) is located outside (i.e., above) the housing 110 beyond the fourth area 115 in the up-down direction.

In a state where the printing cassette 10 is mounted on the housing 110, the printing cassette 10 protrudes outside (i.e., above) the housing 110 beyond the first area 112, the second area 113, the third area 114, and the fourth area 115 in the up-down direction.

In addition, in a state where the printing cassette 10 is mounted on the housing 110, at least a portion (i.e., an upper portion) of the first side-surface 35A and at least a portion (i.e., an upper portion) of the second side-surface 35B of the case 35 do not overlap the housing 110 in the front-rear direction.

In a state where the printing cassette 10 is mounted on the housing 110, the entirety of the first case portion 31 and an upper portion of the first frame portion 32 are located above the first area 112 and the second area 113. That is, at least a portion of the first roll 11 is located above the first area 112 and the second area 113.

The outlet 33C for the to-be-printed tape 11A is located inside the housing 110. Thus, in a state where the printing cassette 10 is mounted on the housing 110, the to-be-printed tape 11A is conveyed in the case 35 in a direction toward the inside of the housing 110 (i.e., downward) with respect to the first area 112 and the second area 113 in the up-down direction.

In a state where the printing cassette 10 is mounted on the housing 110, the entirety of the second frame portion 33 and the entirety of the second case portion 34 are located below the first area 112 and the second area 113. That is, the second roll 14 is located below the first area 112 and the second area 113. The output gear 18 is also located below the first area 112 and the second area 113.

[1-2. Effects]

According to the illustrative embodiment described in detail above, the following effects may be obtained.

(1a) In a state where the printing cassette 10 is mounted on the housing 110, the particular portion of the printing cassette 10 is located outside the housing 110 beyond the first surface 111. Thus, the printing cassette 10 may be held and removed from the housing 110 without a tab. As a result, an increase in cost of the printing cassette 10 may be avoided.

(1b) The output gear 18 is located below the first area 112 and the second area 113 in a state where the printing cassette 10 is mounted on the housing 110. Thus, the particular portion of the printing cassette 10 may be located outside the housing 110 beyond the first surface III while a driving force from the output gear 18 is transmitted to the platen gear 104.

2. Second Illustrative Embodiment

[2-1. Configuration]

Figure 14A:
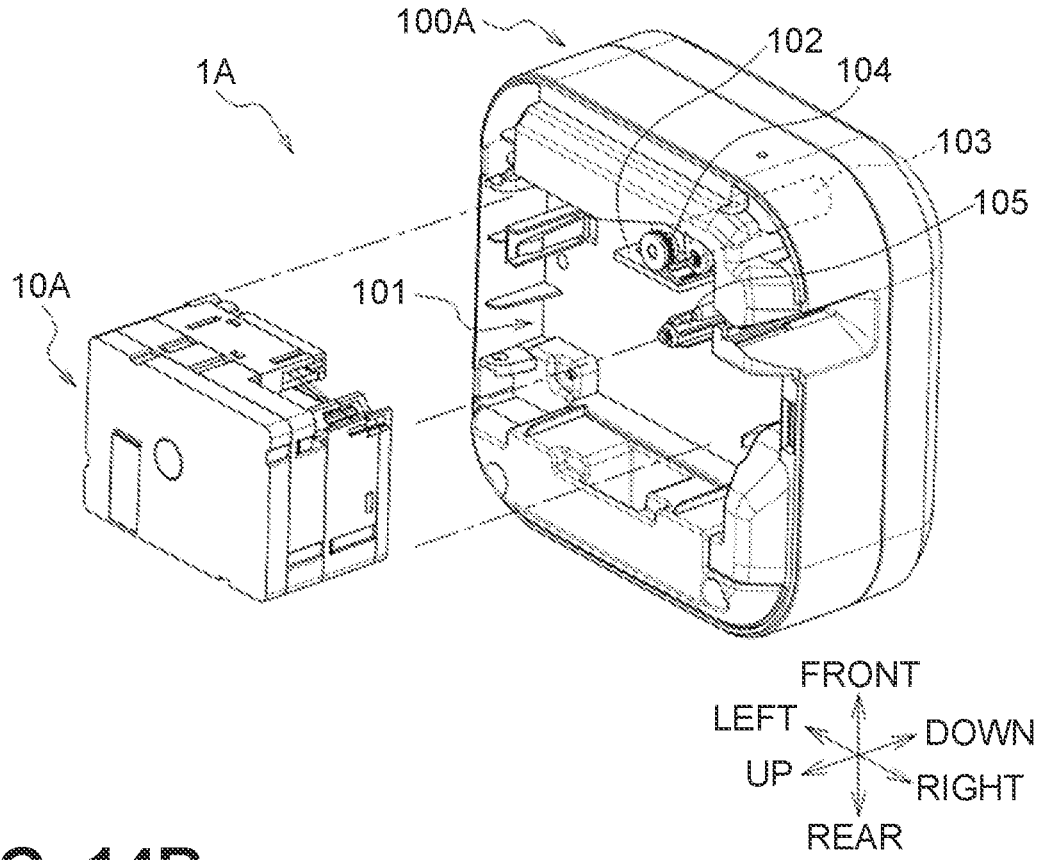
FIGS. 14A and 14B are schematic perspective views each illustrating a state where a printing cassette is detached from a printer body in a printer according to another illustrative embodiment different from the illustrative embodiment illustrated in FIG. 1A.
Figure 14B:
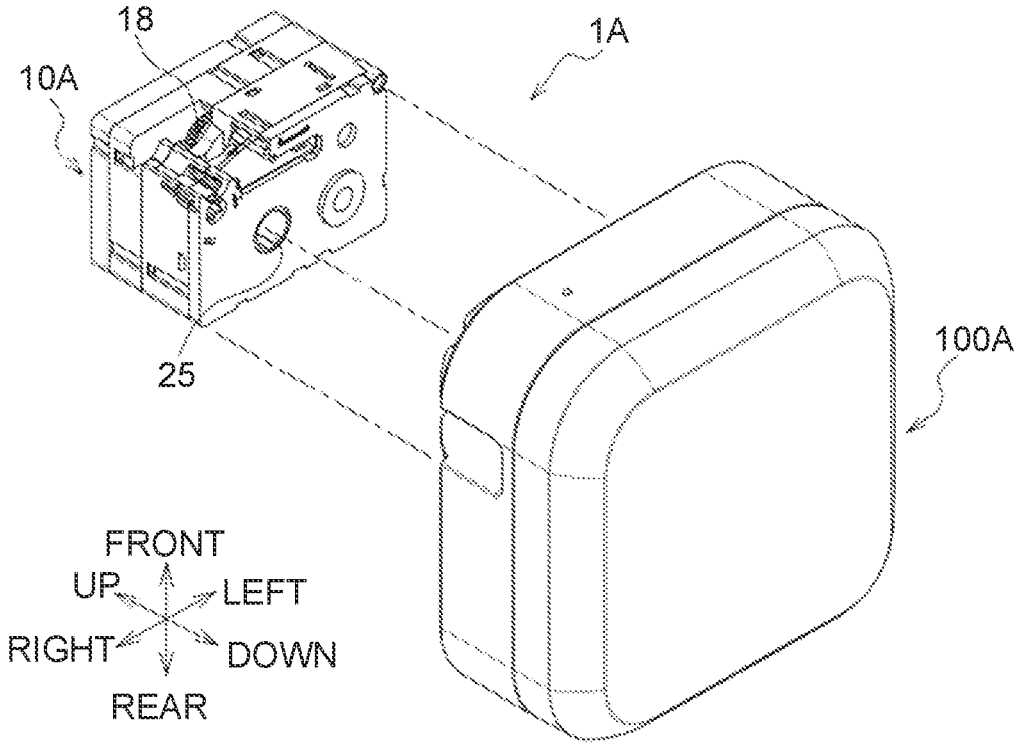

A printer 1A illustrated in FIGS. 14A and 14B includes a printing cassette 10A and a printer body 10A.

In FIGS. 14A and 14B, a cover and a pressing member of the printer body 100A are not illustrated. The pressing member of the printer body 100A may be identical to the pressing member 121 of the printer body 100 of FIG. 1A.

<Printing Cassette>

Figure 15:
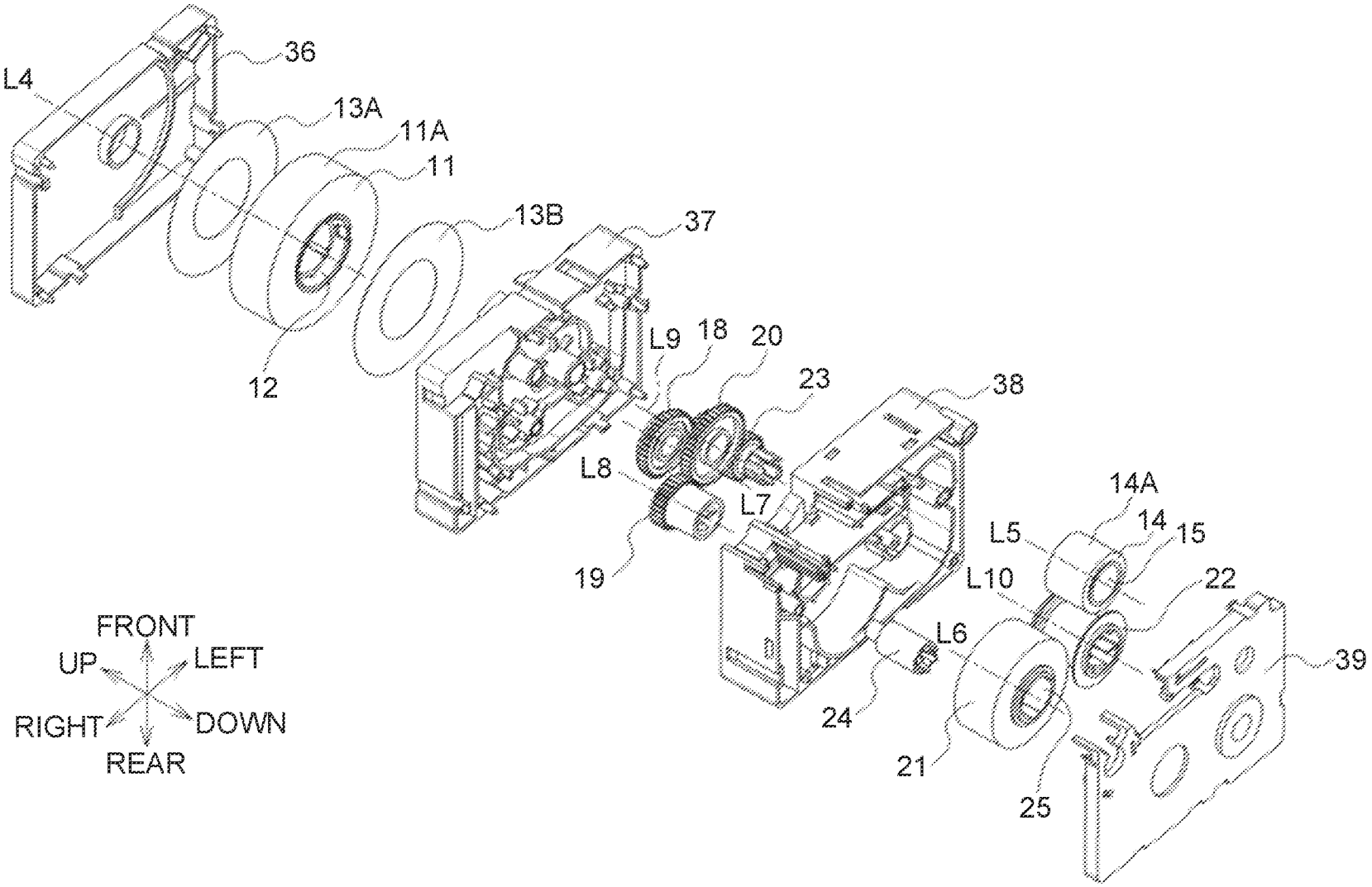
FIG. 15 is a disassembled schematic perspective view of the printing cassette in the printer of FIG. 14A.

The printing cassette 10A includes a third roll 21, a take-up spool 22, a take-up gear 23, and a pinch roller 24, each of which are illustrated in FIG. 15, in addition to the components of the printing cassette 10 of the first illustrative embodiment, and further includes an input spool 25, a first case portion 36, a first frame portion 37, a second frame portion 38, and a second case portion 39 as alternatives to the input spool 16, the first case portion 31, the first frame portion 32, the second frame portion 33, and the second case portion 34 of the printing cassette 10 of the first illustrative embodiment.

The input spool 25 may be identical to the input spool 16 except that the input spool 25 does not have the spline teeth 16B. The first case portion 36, the first frame portion 37, the second frame portion 38, and the second case portion 39 may be identical to the first case portion 31, the first frame portion 32, the second frame portion 33, and the second case portion 34 that are further extended in the right-left direction, respectively. The other configurations of the printing cassette 10A may be the same as those of the printing cassette 10 of the first illustrative embodiment except for the points described below, and thus a description thereof will be omitted.

In the third roll 21, a laminating tape used for protecting the to-be-printed tape 11A is wound around the input spool 25. The laminating tape has an adhesive surface to be adhered to the to-be-printed tape 11A on which printing has been performed by the print head 102.

The take-up spool 22 is rotatable about its rotation axis L10. The rotation axis L10 of the take-up spool 22 is parallel to the rotation axis L5 of the second feed spool 15 (i.e., the up-down direction). The take-up spool 22 takes up the ink ribbon 14A by rotation of the take-up gear 23.

The take-up gear 23 is connected to the take-up spool 22 and is in engagement with the idle gear 20. The take-up gear 23 is rotated by a driving force input to the input gear 19 and rotates the take-up spool 22.

The pinch roller 24 presses the laminating tape toward the to-be-printed tape 11A on which printing has been performed, in cooperation with a pressing roller 106. The pinch roller 24 is disposed downstream from the head opening 33B in a conveyance direction of the to-be-printed tape 11A.

<Printer Body>

Figure 16:
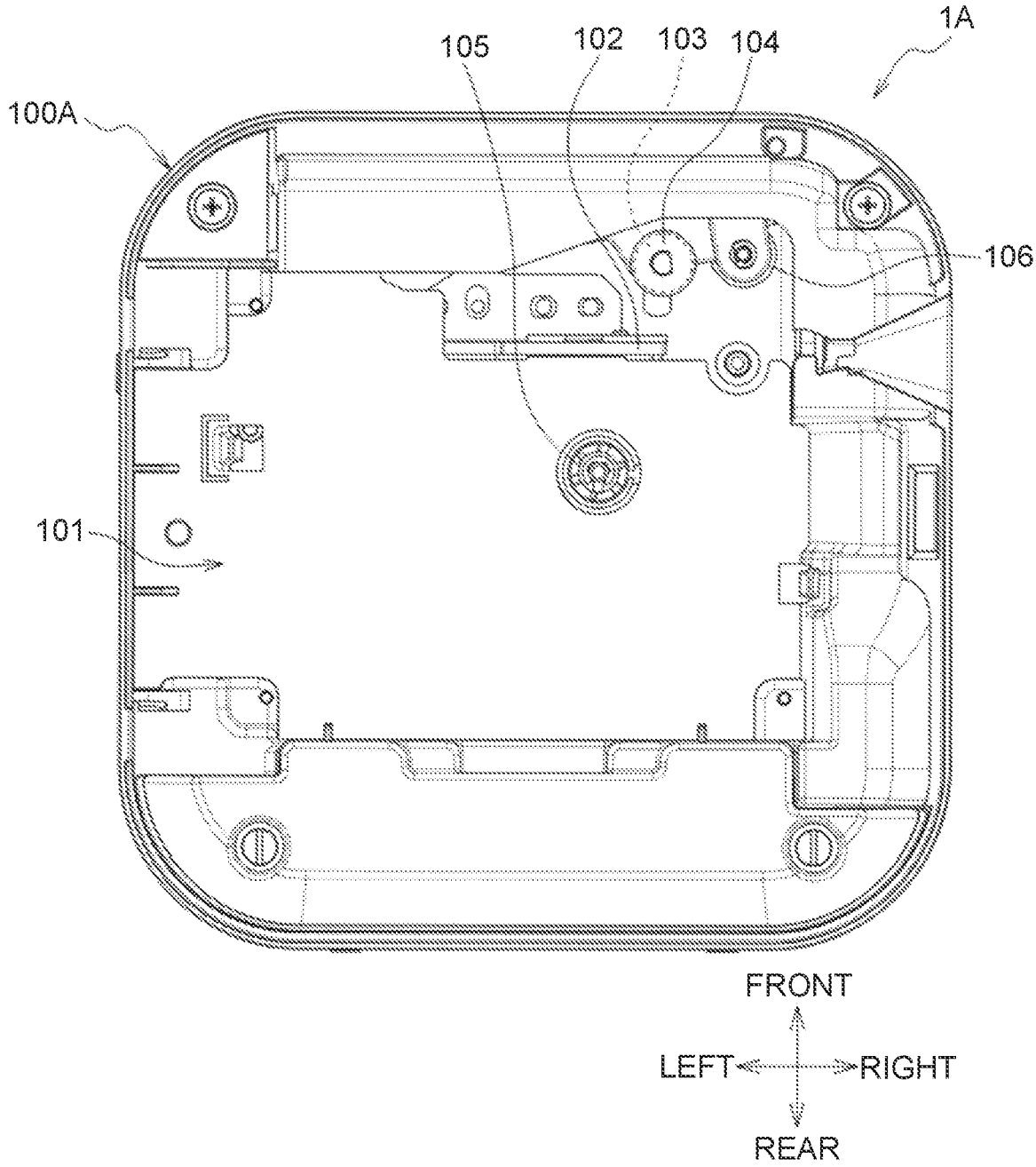
FIG. 16 is a schematic plan view illustrating the printer body of the printer of FIG. 14A.

The printer body 100A may be identical to the printer body 100 of the first illustrative embodiment to which the pressing roller 106 illustrated in FIG. 16 is added. The other configurations of the printer body 100A may be the same as those of the printer body 100 of the first illustrative embodiment except for the points described below, and thus a description thereof will be omitted.

Figure 17:
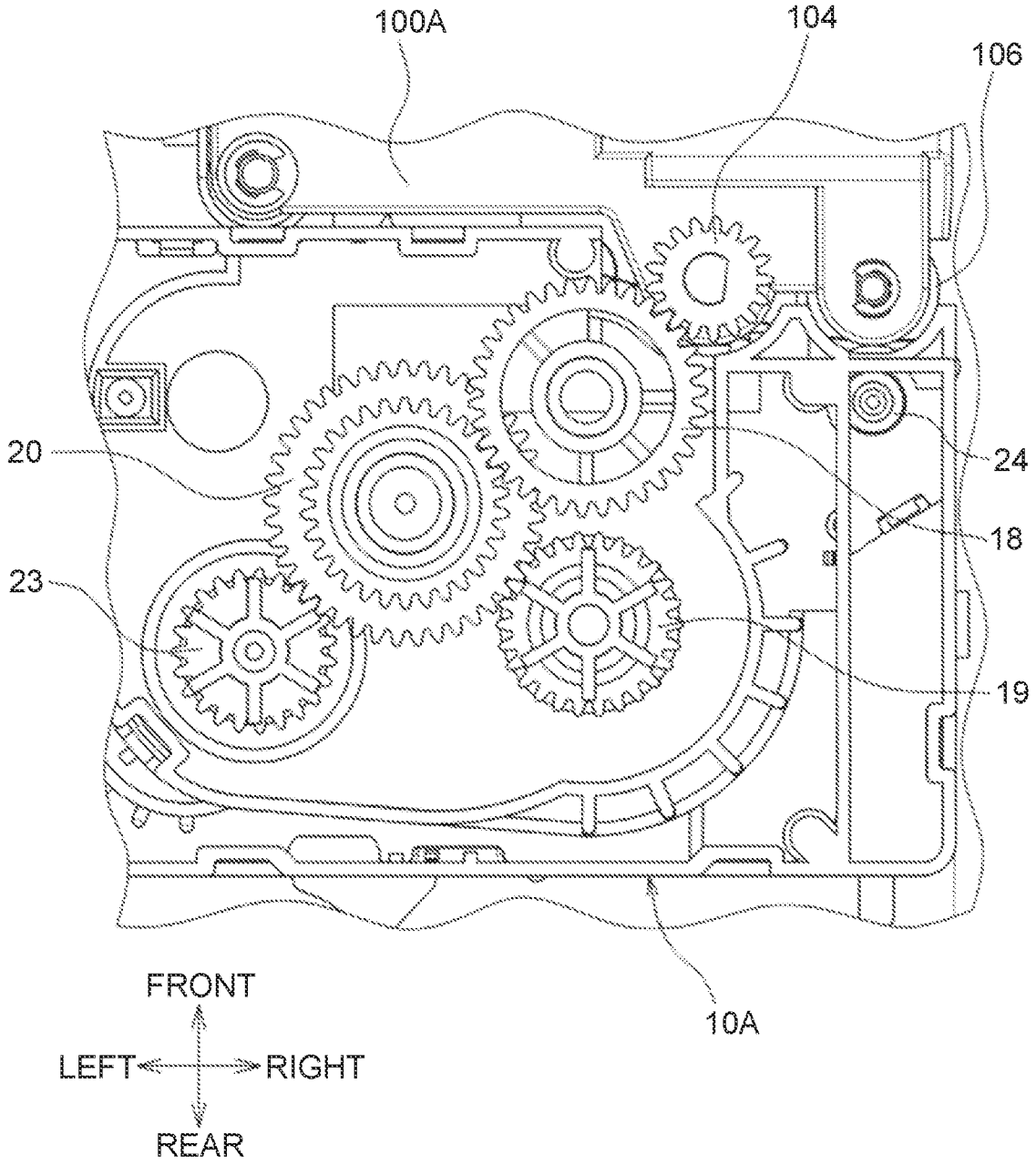
FIG. 17 is a schematic view illustrating a state where an output gear and a platen gear are in engagement with each other in the printer of FIG. 14A.

The pressing roller 106 is configured to be swingable together with the platen roller 103 and the platen gear 104. That is, the pressing roller 106 is swingable between a position illustrated in FIG. 16 where the pressing roller 106 is spaced from the printing cassette 10A and a position illustrated in FIG. 17 where the pressing roller 106 presses the to-be-printed tape 11A and the laminating tape in cooperation with the pinch roller 24.

[2-2. Effects]

According to the illustrative embodiment described in detail above, the following effects may be obtained.

(2a) While having the same advantages as those of the first illustrative embodiment, contents printed on the to-be-printed tape 11A may be protected by the laminating tape.

3. Other Illustrative Embodiments

Although the illustrative embodiments of the disclosure have been described above, it is needless to say that the disclosure is not limited to the above-described illustrative embodiments and may adopt various embodiments.

(3a) The printers of the above-described illustrative embodiments are not limited to printers that perform printing using an ink ribbon. The printers may use a heat-sensitive sheet that is a continuous strip as an alternative to the to-be-printed tape of the first illustrative embodiment, and a laminating tape (i.e., a protective tape) as an alternative to the ink ribbon of the first illustrative embodiment.

Further, the printers may use, as a to-be-printed tape, a stencil tape on which a printing pattern is to be perforated by a thermal head, and as a second tape, a slip sheet that is a continuous strip for protecting and supporting the stencil tape. In this case, at a head opening, the to-be-printed tape may be laid on the slip sheet at a position closer to a print head than the slip sheet to the print head (i.e., as an upper layer) or at a position farther from the print head than the slip sheet from the print head (i.e., as a lower layer).

(3b) The printing cassettes of the above-described illustrative embodiments are not limited to a printing cassette in which a first roll, an output gear, and a roll (i.e., a second roll or a third roll) of an auxiliary tape to be used for printing or protecting a to-be-printed tape are arranged in the up-down direction. In the printing cassette, the first roll may be disposed overlapping the second roll or the third roll in a direction orthogonal to the up-down direction.

(3c) The printing cassettes of the above-described illustrative embodiments may include two or more idle gears. Further, the idle gear might not necessarily be a stepped gear, and may be a single gear. Further, the printing cassette may not necessarily have an idle gear, and the output gear may be directly engaged with the input gear.

(3d) The printing cassette of the second illustrative embodiment may include a third feed spool around which a laminating tape is wound as an alternative to the take-up spool. In the printing cassette according to the second illustrative embodiment, the input spool may be used as a take-up spool for an ink ribbon.

(3e) The functions of a single component in the above-described illustrative embodiments may be achieved by multiple components, or the functions of respective multiple components may be achieved by a single component. Further, some of the configurations of the above-described illustrative embodiments may be omitted. In addition, at least some of the configurations of one or more of the above-described illustrative embodiments may be added to or replaced with the configurations of another embodiment. It should be noted that all aspects included in the technical idea specified by the wording described in the claims are embodiments of the disclosure.

What is claimed is:

1. A printer comprising:

a housing having a first surface having a cassette mounting opening;

a print head disposed in the housing, the print head extending toward the cassette mounting opening from an inside of the housing;

a platen roller disposed in the housing, the platen roller facing the print head; and a printing cassette mountable on the housing by insertion to the cassette mounting opening in a first direction, wherein:

the first surface has:

a first area adjacent to the cassette mounting opening; and a second area adjacent to the cassette mounting opening, the second area being opposite to the first area with respect to the cassette mounting opening in a second direction orthogonal to the first direction, the first area and the second area are located upstream from the print head in a direction in which the printing cassette is mounted to the housing, and in a state where the printing cassette is mounted on the housing, a portion of the printing cassette adjacent to the first area is located outside the housing beyond the first area in the first direction and a portion of the printing cassette adjacent to the second area is located outside the housing beyond the second area in the first direction.

2. The printer according to claim 1, wherein:

the printing cassette includes a first roll into which a printing tape is wound, and in a state where the printing cassette is mounted on the housing, at least a portion of the first roll is located outside the housing beyond the first area and the second area.

3. The printer according to claim 2, wherein:

the printing cassette includes a case accommodating the first roll, and in a state where the printing cassette is mounted on the housing, the printing tape is conveyed in the case in a direction toward an inside of the housing with respect to the first area and the second area in the first direction.

4. The printer according to claim 1, wherein:

the printing cassette includes a second roll into which an ink ribbon is wound, and in a state where the printing cassette is mounted on the housing, the second roll is located within a range of the housing not beyond the first area and the second area in the first direction.

5. The printer according to claim 1, wherein:

the printing cassette includes a gear configured to transmit a driving force, and in a state where the printing cassette is mounted on the housing, the gear is located within a range of the housing not beyond the first area and the second area in the first direction.

6. The printer according to claim 1, wherein:

the first surface further has a third area and a fourth area, both of which are adjacent to the cassette mounting opening, the third area and the fourth area being located between the first area and the second area in the second direction, the fourth area located opposite to the third area with respect to the cassette mounting opening in a third direction orthogonal to the first direction and the second direction, and in a state where the printing cassette is mounted on the housing, a portion of the printing cassette adjacent to the third area is located outside the housing beyond the third area in the first direction and a portion of the printing cassette adjacent to the fourth area is located outside the housing beyond the fourth area in the first direction.

7. The printer according to claim 1, further comprising a cover being openable and closable with respect to the housing, wherein the cover contacts the first surface when the cover is closed.

8. The printer according to claim 1, wherein the print head and the platen roller face each other in the second direction.

9. The printer according to claim 1, wherein the first area, the second area, and the print head are located at respective positions such that a virtual plane passes through the first area, the second area, and the print head, the virtual plane extending parallel to the first direction.

10. A printer comprising:

a housing having a first surface having a cassette mounting opening;

a print head disposed in the housing, the print head extending toward the cassette mounting opening from an inside of the housing;

a platen roller disposed in the housing, the platen roller facing the print head; and a printing cassette mountable on the housing by insertion to the cassette mounting opening in a first direction, wherein:

the first surface has:

a first area adjacent to the cassette mounting opening;

a second area adjacent to the cassette mounting opening, the second area being opposite to the first area with respect to the cassette mounting opening in a second direction orthogonal to the first direction, the first area and the second area are located upstream from the print head in a direction in which the printing cassette is mounted to the housing, and in a state where the printing cassette is mounted on the housing, the printing cassette protrudes outside the housing beyond the first area and the second area in the first direction.

11. A printer comprising:

a housing having a first surface having a cassette mounting opening;

a print head disposed in the housing, the print head extending toward the cassette mounting opening from an inside of the housing;

a platen roller disposed in the housing, the platen roller facing the print head; and a printing cassette mountable on the housing by insertion to the cassette mounting opening in a first direction, wherein:

the printing cassette has a first side-surface and a second side-surface overlapping each other in a second direction orthogonal to the first direction, and in a state where the printing cassette is mounted on the housing, at least a portion of the first side-surface and at least a portion of the second side-surface do not overlap the housing in the second direction.

* * * * *